United States Patent [19]

Woodworth

[11] 4,298,549

[45] Nov. 3, 1981

Best Available Copy

[54] CARBURETOR

[75] Inventor: Albert H. Woodworth, Carlsbad, Calif.

[73] Assignee: Woodworth Carburetor Corp. of Nevada, Carlsbad, Calif.

[21] Appl. No.: 88,944

[22] Filed: Oct. 29, 1979

[51] Int. Cl.[3] ..... F02M 7/22

[52] U.S. Cl. ..... 261/39 B; 261/50 A; 261/64 E; 261/121 B

[58] Field of Search ..... 261/50 A, 44 C, 39 B, 261/64 E, 121 B

[56] References Cited

U.S. PATENT DOCUMENTS

| | | | |
|---|---|---|---|
| 2,136,353 | 11/1938 | Weber | 261/50 A |
| 2,600,368 | 6/1952 | Winkler | 261/50 A |
| 2,855,283 | 10/1958 | Schumacher | 261/50 A |
| 2,996,051 | 8/1961 | Mick . | |
| 3,003,755 | 10/1961 | Peras . | |
| 3,078,079 | 2/1963 | Mick | 261/50 A |
| 3,190,623 | 6/1965 | Ball | 261/39 B |
| 3,278,173 | 10/1966 | Cook et al. | 261/50 A |
| 3,281,131 | 10/1966 | Mennesson | 261/50 A |
| 3,284,063 | 11/1966 | Bickhaus et al. . | |
| 3,309,069 | 3/1967 | Braun et al. . | |
| 3,313,531 | 4/1967 | Winkley et al. | 261/39 B |
| 3,432,152 | 3/1966 | Sweeney | 261/50 A |
| 3,485,483 | 12/1969 | Pohlman . | |
| 3,493,217 | 2/1970 | Farley | 261/50 A |
| 3,712,275 | 1/1973 | Jackson | 261/50 A |
| 3,721,428 | 3/1973 | Gele et al. | 261/50 A |
| 3,752,451 | 8/1973 | Kendig . | |
| 3,834,679 | 9/1974 | Baribeau et al. | 261/116 |
| 3,837,322 | 9/1974 | Shishido et al. | 261/64 E |
| 3,956,434 | 5/1976 | Dickensheets et al. | 261/50 A |

FOREIGN PATENT DOCUMENTS

| | | | |
|---|---|---|---|
| 2503848 | 8/1976 | Fed. Rep. of Germany | 261/50 A |

*Primary Examiner*—Tim R. Miles

[57] ABSTRACT

Disclosed is a carburetor which regulates the supply of fuel and air in response to the vacuum pressure conditions in the mixing chamber between a downstream butterfly throttle valve and an upstream butterfly air valve. Liquid fuel is supplied to the mixing chamber through a nozzle with a number of small orifices and its delivery is controlled by a fuel supply valve operated by the air valve shaft. The air valve and fuel supply valve are operated in unison by a vacuum responsive actuator connected to the mixing chamber and adapted to adjust the air flow through the air valve in response to mixing chamber vacuum pressure. A second vacuum responsive actuator connected to the intake manifold is used to enrichen or lean the fuel mixture ratio in response to engine demand by bleeding air into the fuel supply line between the fuel valve and nozzle. The fuel valve has a vertically reciprocal piston which is operated in a vertical bore in the carburetor housing by an eccentric pin on the air valve shaft, and a cam follower with a self adjusting fulcrum. Choking for cold engine starts is achieved by biasing the air valve butterfly or regulating an outside air bleed line by a temperature responsive valve.

11 Claims, 37 Drawing Figures

CARBURETOR

BACKGROUND OF INVENTION

The invention relates generally to fuel supply systems for internal combustion engines and more particularly to carburetors which form the combustible mixture supplied to the engine independent of the velocity of air flow through the carburetor throat.

The increasing problem of air pollution from automobile exhaust emissions has resulted in stringent new emission controls being placed on the automotive industry. At the same time, the public's desire for greater engine performance and more auxiliary components such as automobile air conditioning have substantially reduced gasoline mileage while fuel costs have risen and supplies are running short. This unfortunate combination of conditions has placed such performance demands on the gasoline powered internal combustion engine that its future usefulness as a power source is presently under question. Since the problems of harmful exhaust emissions are directly related to the efficiency of fuel combustion, carburetor design is receiving considerable attention.

Most gasoline powered automobile engines have, for a number of years, used a venturi type carburetor. In this type carburetor the gasoline is drawn into the throat through venturi jets responsive to the passing flow of air. Under certain operating conditions this means of deriving a combustible mixture has significant limitations. This has resulted in many accessories and modifications being added over the years. In most of todays automobiles, for example, the carburetors include an automatic-thermal responsive choking device and associated fast idle throttle linkage, an idle by-pass system, a high speed jet, an acceleration pump and other similar accessories. These accessories plus the techniques of increasing the throat size, compartmentalizing into "two barrel" and "four barrel" carburetors, and the addition of smog control devices which backfeed exhaust gases, have resulted in extremely complex carburetors which are not only expensive to manufacture and maintain but which have provided only mediocre performance as well.

A need, therefore, exists for an improved carburetor which can meet current requirements for high performance of the engine, and yet provide reasonable economy and reduced harmful exhaust emissions.

OBJECTS OF INVENTION

It is, therefore, a main object of my invention to provide an improved carburetor for internal combustion engines which substantially increases the combustion efficiency of the engine.

It is also an important object of my invention to provide a carburetor for an internal combustion engine in which the supply of combustion mixture components to the mixing chamber is positively controlled to maintain the mixing chamber vacuum pressure at a minimal, relatively constant amount.

A further important object of my invention is to provide a carburetor for internal combustion engines in which the mixture ratio between combustion mixture components is relatively constant under normal operating conditions of the engine.

Another object of my invention is to provide a carburetor of the type described in which the fuel supply and the air supply are each regulated in unison by valves driven by a vacuum responsive actuator responsive to vacuum pressure in the mixing chamber.

A further object of my invention is to provide a carburetor of the type described in which fuel is supplied to the mixing chamber through a nozzle with several orifices and so pre-mixed with air as to provide more complete dispersement and mixing.

Still another object of my invention is to provide a carburetor of the type described in which the mixture ratio between fuel and air can be varied, when called for by engine demand, as indicated by manifold vacuum pressure.

Still a further object of my invention is to provide a carburetor of the type described in which the combustible mixture components may be supplied to the carburetor by either a float and bowl fuel supply reservoir or a pressure system.

Yet another object of my invention is to provide a carburetor of the type described in which the fuel supply is promptly shut down to idle flow on rapid deceleration to prevent engine soak and the passing of unburned fuel in the exhaust emissions.

Yet a further object of my invention is to provide a carburetor of the type described which is considerably less expensive to manufacture than currently used carburetors, is smaller in size, and requires very little maintenance.

These and other objects and advantages of my invention will become more readily apparent from the following detailed description of a preferred embodiment and the accompanying drawings, in which:

DETAILED DESCRIPTION OF PARTS

Figure 1:
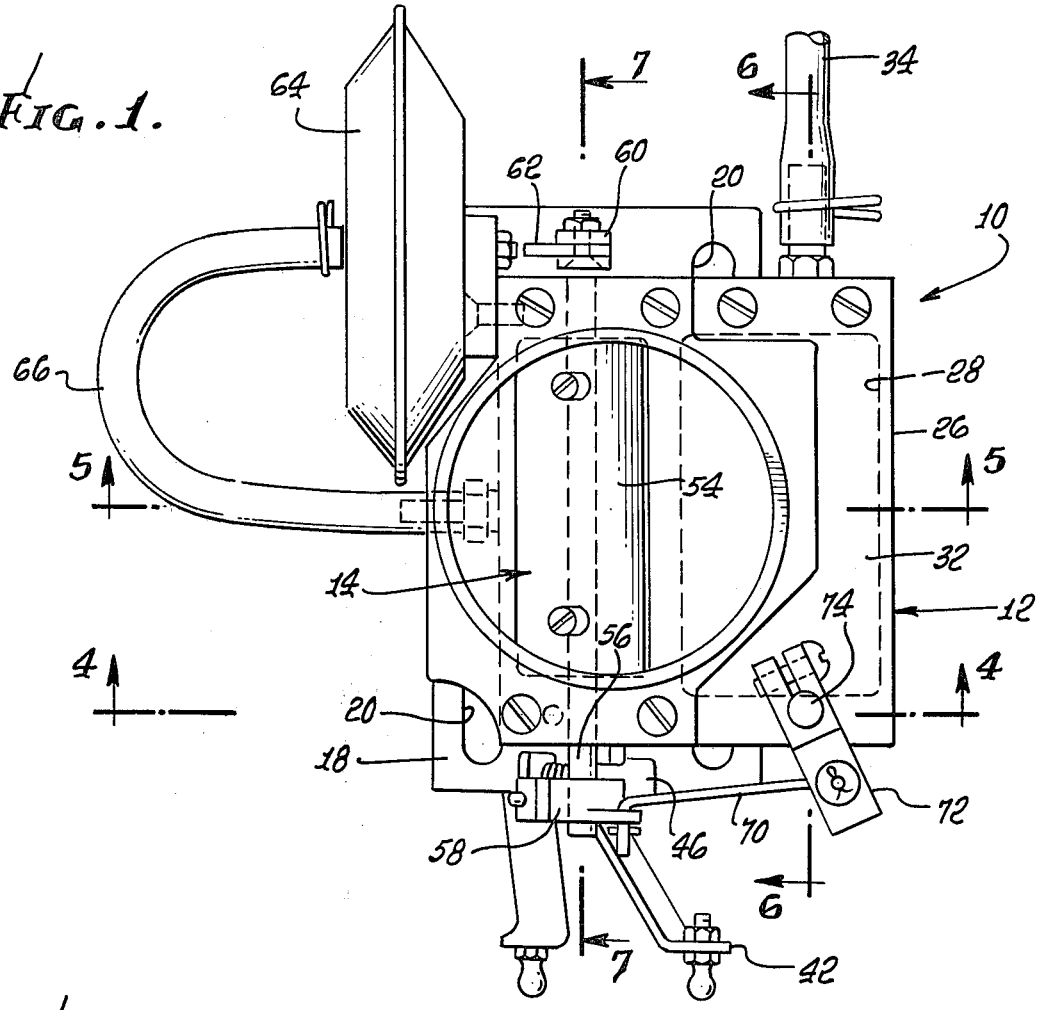
FIG. 1 is a plan view of a first preferred embodiment of my invention.
Figure 2:
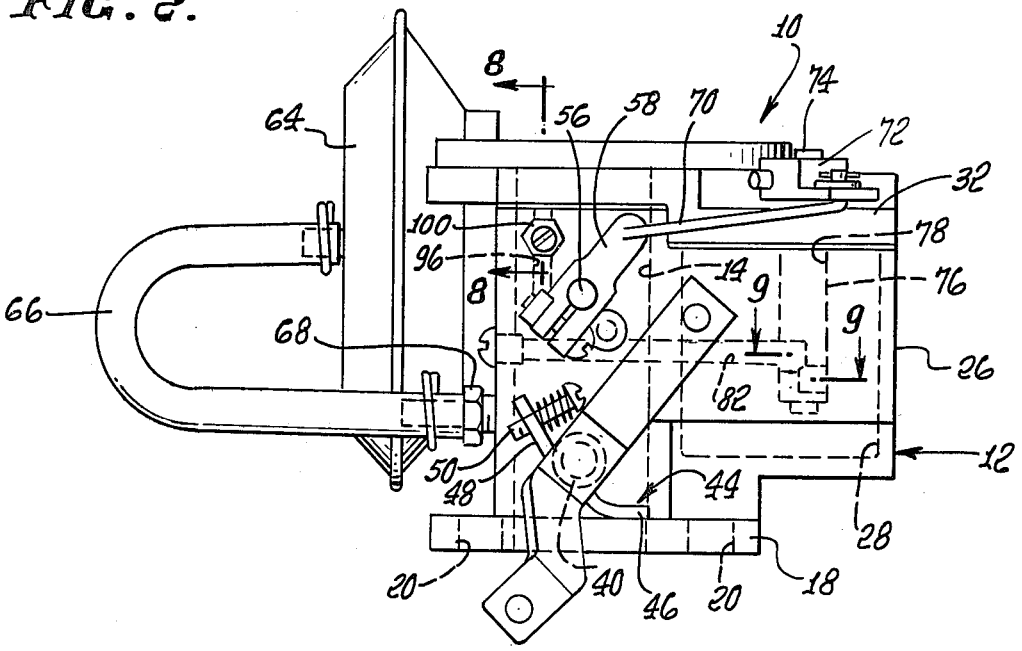
FIG. 2 is a side elevational view of the first preferred embodiment from the throttle valve control side.
Figure 3:
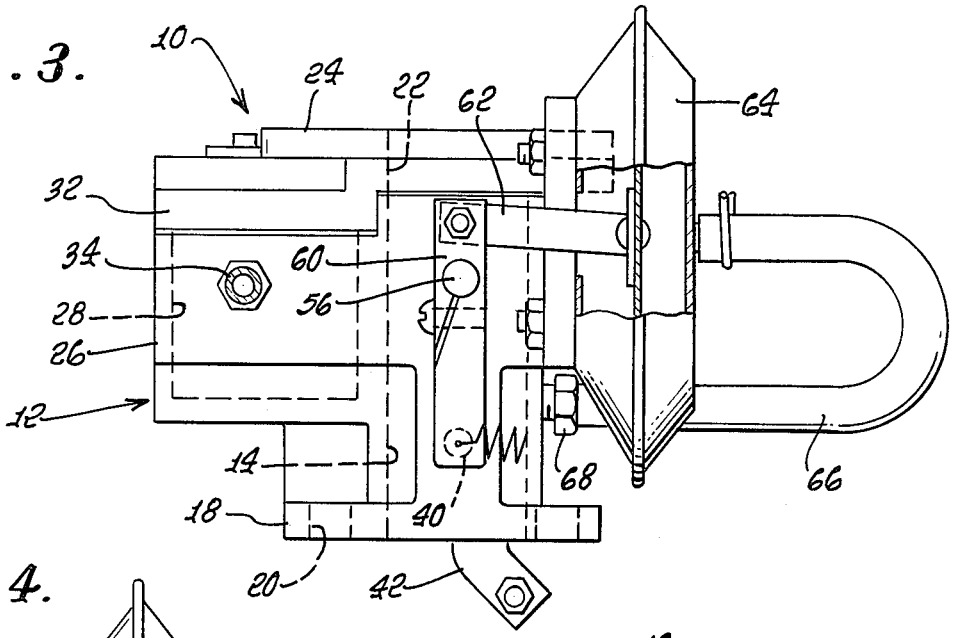
FIG. 3 is a side elevational view of the first preferred embodiment from the air valve control side.
Figure 4:
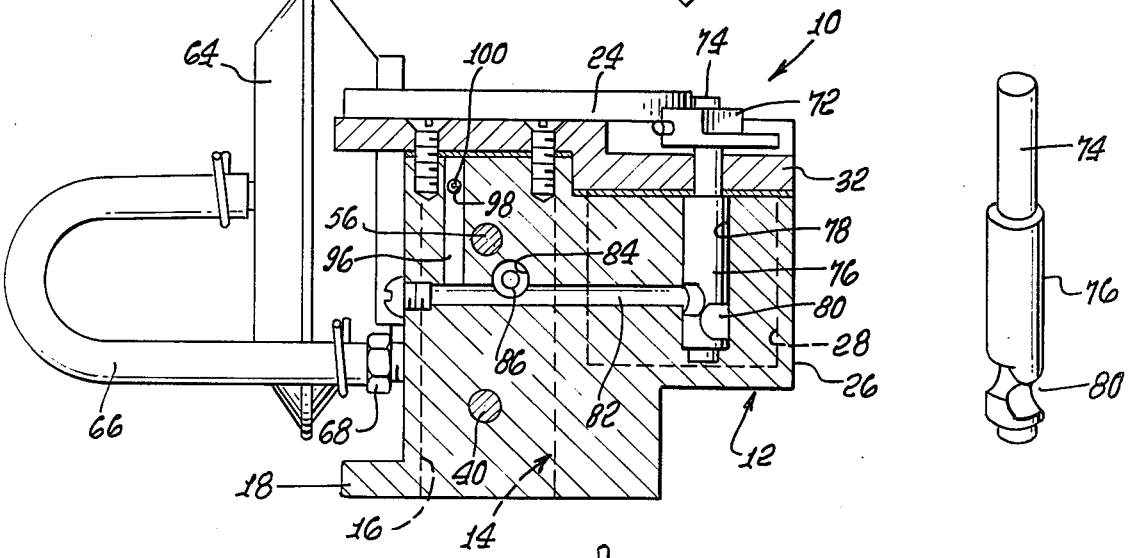
FIG. 4 is a sectional view taken on line 4—4 in FIG. 1 and shows the fuel supply channels in the carburetor housing.
Figure 5:
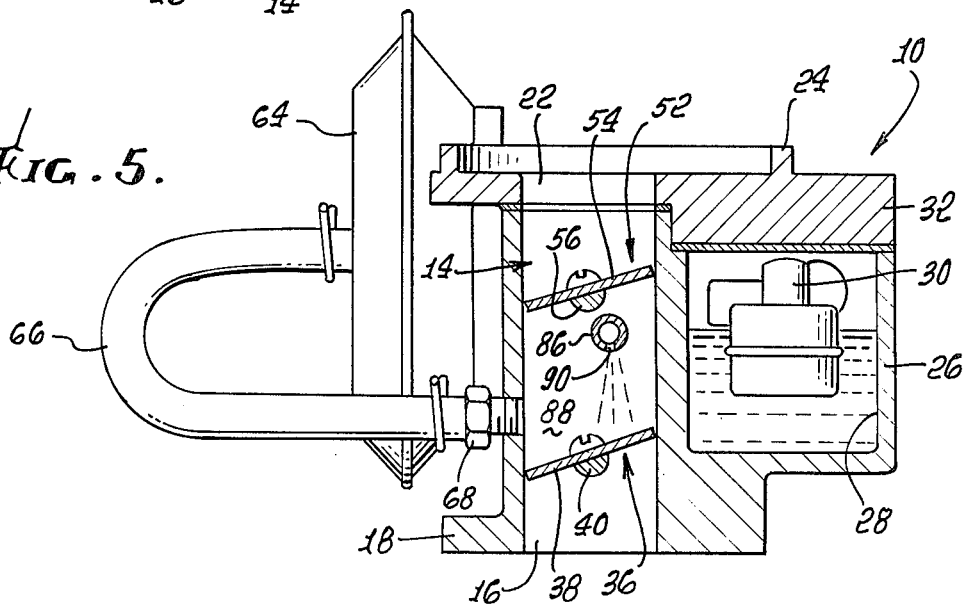
FIG. 5 is a sectional view taken on line 5—5 in FIG. 1 and shows the mixing chamber in the carburetor throat.
Figure 6:
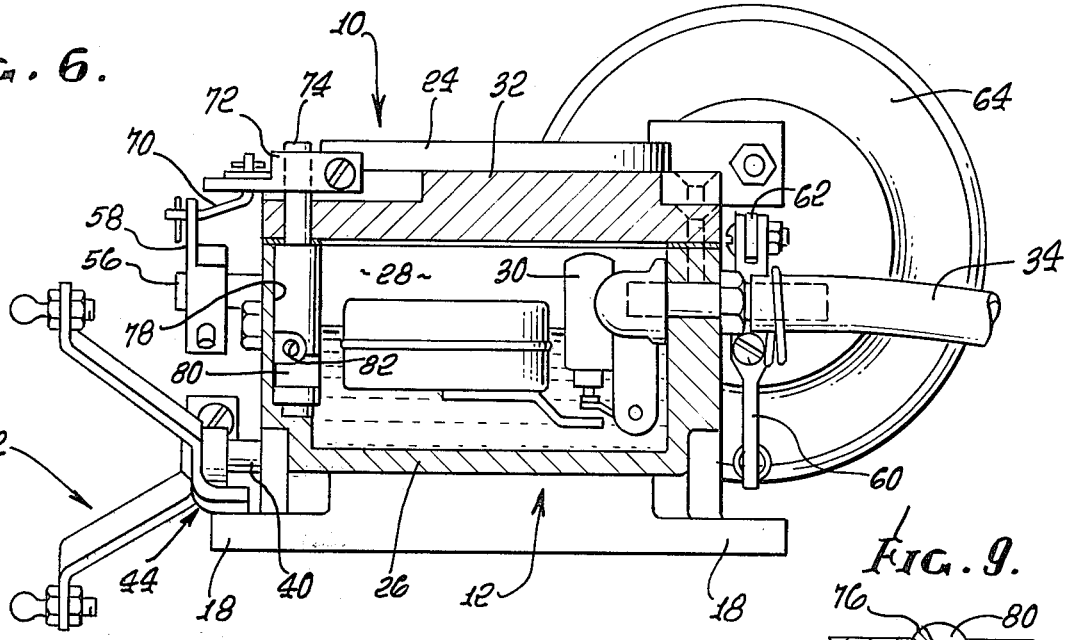
FIG. 6 is a sectional view taken on line 6—6 in FIG. 1 and shows the float and bowl fuel supply.
Figure 9:
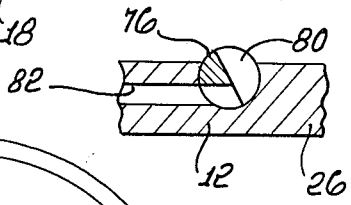
FIG. 9 is a partial sectional view taken at 9—9 in FIG. 2.
Figure 7:
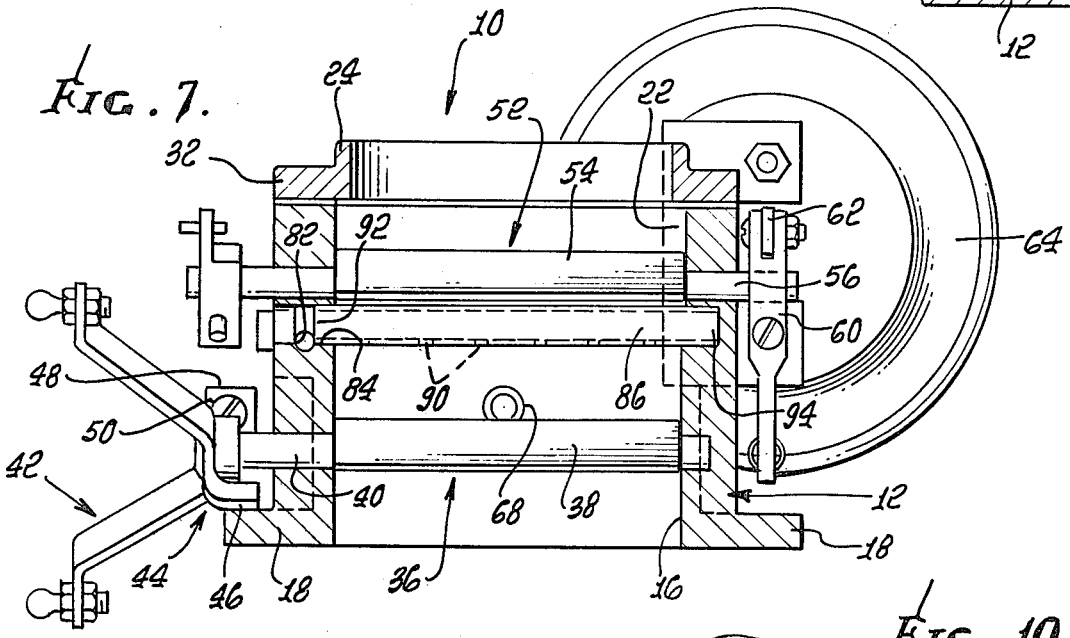
FIG. 7 is a sectional view taken on line 7—7 in FIG. 1 and shows the air valve, throttle valve and mixing chamber.
Figure 8:
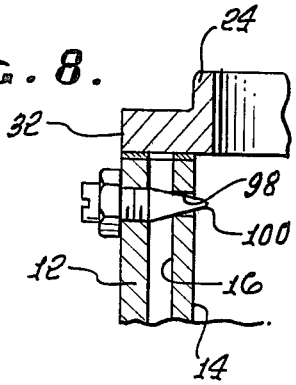
FIG. 8 is a partial sectional view taken at 8—8 in FIG. 2.

Referring now to the drawings, and particularly FIGS. 1 through 9 thereof, the number 10 designates my improved carburetor generally. The carburetor 10 has a housing 12 with a vertically directed barrel or throat 14. On the lower end or exit 16 of the throat 14, a radially projecting flange 18 with bolt holes 20 is provided to mount the carburetor to the intake manifold of an internal combustion engine. At the upper end or entry 22 of the throat 14, a circular upstanding flange 24 is provided for mounting an air cleaner in a manner common in the art.

Adjacent the throat 14 is a fuel supply reservoir 26 which has a bowl 28 and a float valve 30 of the type common to carburetors in the prior art. The bowl 28 is closed by a cover plate 32 and the float valve 30 is connected with a fuel supply hose 34 (see FIGS. 1 and 6) which delivers fuel from the engine fuel pump to the carburetor.

The throat 14 is generally rectangular and has a butterfly type throttle 36 mounted near the exit 16. The throttle valve 36 has a generally rectangular blade 38 conformed to the shape of but slightly larger than the throat 14, mounted on a rotating rod 40. A double ended crank arm 42 is mounted on an outwardly projecting end of the throttle valve rod 40 and has throttle linkage connected to the first end and a return spring connected to the second end, in a manner well known in the art. A double ended throttle stop 44 is attached to the throttle valve crank arm 42 and is positioned so its ends alternately engage the flange 18 to limit the rotation of the rod 40. A first end 46 engages the flange 18 when the throttle valve reaches its maximum open position and a second end 48 engages the flange when the throttle valve approaches its fully closed position. An adjustment screw 50 is provided in the second end 48 so that the exact stop position can be regulated to provide an engine idle throttle opening in the customary manner in the art.

At the entry end 22 of the throat 14, I provide a butterfly type air valve 52 which is mounted in the throat 14 and has a blade 54 and a rotatable rod 56. Again, the blade 54 is conformed to the throat 14 but is slightly larger to give a complete closing. The rod 46 projects from the housing 12 at both ends and has a fuel valve crank arm 58 mounted on one end and a vacuum actuator crank arm 60 on the other.

The vacuum actuator crank arm 60 is connected by vacuum actuator linkage 62 to a vacuum responsive actuator 64. The vacuum responsive actuator 64 is mounted on the housing 12 and has a vacuum hose 66 which is connected in communication with the throat 14 between the throttle valve 36 and the air valve 52 by a tapered fitting 68.

The fuel valve crank arm 58 is connected by fuel valve linkage 70 to a fuel supply valve crank arm 72 which is mounted on the rotatable stem 74 of a fuel supply valve 76. The fuel supply valve 76 is a metering valve and has a vertical bore 78 which opens into the bowl 28 of fuel supply reservoir 26. The rotatable stem 74 is rotatably mounted in the bore 78 and has a cutaway passage 80 which communicates with a fuel supply channel 82 in the housing 12 when the stem is properly positioned. The stem cutaway passage 80 is so configured that flow through the fuel supply valve 76 is increased from a closed position to a maximum open position in direct proportion to the degrees of rotation of the stem 74 within the bore 78. The fuel which passes through fuel supply valve 76 into the fuel supply channel 82 is delivered to a nozzle port 84 which is connected with a nozzle 86 that projects into a mixing chamber 88 in the throat 14. The mixing chamber 88 is the portion of throat 14 between the throttle valve 36 and the air valve 52. The nozzle 86 extends completely across the throat 14 in the mixing chamber and has a number of orifices 90 from which fuel is delivered to the mixing chamber. The proximal end 92 of the nozzle is in fluid communication with the nozzle port 84 and the distal end 94 is plugged. (See FIG. 7)

The orifices 90 in the nozzle 86 are sufficiently small and numerous to cause atomization of the fuel as it flows from the nozzle into the air stream passing down the throat 14 through the mixing chamber 88. To increase the atomization of the fuel in the mixing chamber 88, a pre-mix air supply channel 96 is provided in the housing 12. (See FIGS. 2 and 8) The pre-mix air supply channel 96 connects to the fuel supply channel 82 at its junction with the nozzle port 84 and extends through the housing to a point near the throat entry 22 and above the air valve 52. Here the pre-mix air supply channel 96 is connected with the throat 14 by a pre-mix air supply port 98. A needle valve 100 is provided in the pre-mix air supply port 98 to permit regulation of the air passing through the pre-mix air supply channel 96. By properly adjusting the size of the orifices 90 and the supply of pre-mix air, excellent atomization of fuel in the mixing chamber is possible.

It is important at this point to note that the rectangular configuration of the throat 14 and the air valve blade 54 combines to provide air flow through the air valve which varies in direct proportion to the degrees of rotation of the air valve rod 56, in the same manner as the fuel flow through the fuel supply valve. Since the fuel supply valve 76 is directly connected to the air valve 52 by interconnection of the rotating rod 56 to the rotating stem 74 through fuel valve linkage 70, the supply of fuel and air are fixed in a definite proportion and a constant mixture ratio is maintained.

Further, since the air valve 52 is controlled by the vacuum responsive actuator 64, which in turn responds to maintain a constant vacuum pressure in the mixing chamber 88, the supply of combustible mixture of air and fuel, in a constant mixture ratio, is delivered according to the requirements of the engine. When acceleration is called for by opening the throttle valve 36, the mixture chamber is exposed to a greater proportion of the vacuum pressure in the manifold which is normally between five and sixteen inches of mercury. This exposure tends to raise the vacuum pressure in the mixing chamber 88 above its normal constant which I set at about one-half inch of mercury. This rise is only instantaneous, however, since immediately the vacuum responsive actuator 64 acts to hold the mixing chamber vacuum constant by opening the air valve 52 which permits more outside air to enter the mixing chamber via the throat entry 22 and this in turn reduces the vacuum back to one-half inch.

On deceleration a similar action occurs to close the air valve 52 and hold the one-half inch mixing chamber vacuum when the engine acts to reduce it. Therefore, the vacuum responsive actuator 64 acts similar to a servo system to cause the air valve 52 to follow the throat valve 36 with nearly an instantaneous response and only a slight position lag sufficient to hold one-half inch vacuum pressure in the mixing chamber.

Although it is possible in theory to reduce the mixing chamber pressure to zero inches of mercury and hold it constant at this point, in practical application there must be enough vacuum pressure to keep the vacuum responsive actuator active and riding on a sensed standard pressure. I have found a one-half inch vacuum to be sufficient for this purpose. Preferrably, the mixing chamber pressure should be kept as low as is practical since higher vacuum pressure in the carburetor throat resists the flow of the combustible mixture into the intake manifold of the engine.

OPERATION

Having described the various parts of a first embodiment of my carburetor, I will now describe its operation.

Before the engine is started, the vacuum pressure in the mixing chamber is zero and the air valve 52 is closed because the valve is set to open as necessary to maintain a set vacuum in the mixing chamber. As the engine is rotated by the starter, fuel is pumped into the fuel supply reservoir 26, holding it at the float set level. Since the throttle valve 36 is held slightly open by the idle adjustment screw 50 on the throttle crank arm 42, or is more fully opened by manipulation of the engine operator, the manifold vacuum caused by rotation of the engine is reflected into the mixing chamber 88 and is sufficient to actuate the vacuum responsive actuator 64 and open the air valve 52 and fuel supply valve 76. Fuel and air are thus supplied to the mixing chamber, mixed and passed down the throat 14 through exit 16 and into the engine.

When the engine starts the manifold vacuum pressure is continued and the air valve 52 is adjusted by the vacuum responsive actuator to establish a vacuum of one-half inch of mercury in the mixing chamber. If the throttle valve 36 is at idle speed the setting of the air valve 52 is nearly closed because only a minimal quantity of combustible mixture is required. The ratio of components in the combustible mixture, gasoline and air, is maintained at the level for which the engine is designed because of the direct linkage connection between air valve 52 and the fuel supply valve 76, as previously explained.

Experience has proven that after a minute or two of warm up operation, the engine is sufficiently warm to perform with my carburetor. It may then be applied to a load, and even rapidly accelerated without starving out or stalling. This performance appears to be due to the more positive feed of fuel achieved by my fuel supply valve 76 in comparison to a venturi nozzle fuel feed. Fuel feed in my carburetor is not directly responsive to the volume of passing air, but instead is exactly proportioned to the setting of air valve 52.

When the engine is loaded and accelerated, a vacuum pressure is applied to the mixing chamber as the throttle valve opens and the vacuum responsive actuator responds by opening the air valve 52 and fuel supply valve 76 to deliver more air and fuel to the mixing chamber but at the same mixture ratio, and to take the mixing chamber pressure back to the standard one-half inch.

When a traveling speed is reached and acceleration is ceased to maintain a relatively constant load and speed, the throttle valve 36 is closed somewhat and the air valve 52 shadows it by closing also, thus cutting out the fuel and air at the same ratio and maintaining the standard mixing chamber vacuum pressure.

If an additional load is brought to bear on the engine, as by a hill, or upon acceleration for passing, the throttle valve 36 is opened again calling for a greater volume of combustible mixture. Again, this demand reflects itself in the mixing chamber 88 where it is sensed by the vacuum responsive actuator 64 which reacts to increase the supply of the components, gasoline and air, at the fixed mixture ratio.

Upon deceleration or reduced load, such as by passing the crest of a hill, or slowing to stop, the carburetor responds in the reverse. That is, the vacuum in the mixing chamber reduces—because the pressure rises—and the air valve and fuel supply valve are moved toward close by the vacuum responsive actuator 64, reducing the supply of combustible mixture to the engine.

Although my carburetor which, as previously explained, maintains a fixed fuel to air mixture ratio, which results in substantial improvements in engine performance and economy, I believe that even greater improvement can be made by modifying the carburetor to provide means for changing the mixture ratio under certain engine conditions. For example, opening the throttle valve to call for maximum acceleration when the engine is already under substantial load appears to be a condition which calls for some momentary enrichment of the normal mixture ratio. Such a condition would occur in an automobile, for instance, when it is floorboarded while traveling at sixty miles per hour. Although this condition can be accommodated by a fixed mixture ratio, high performance of the engine requires that the ratio be fixed somewhat richer than would normally be required. Therefore, it is desirable to set the mixture ratio at a leaner mix which effectively respond to most engine conditions and provide means for enriching the mixture to accommodate extreme acceleration conditions, if maximum efficiency obtainable by my carburetor is to be achieved.

Figure 10:
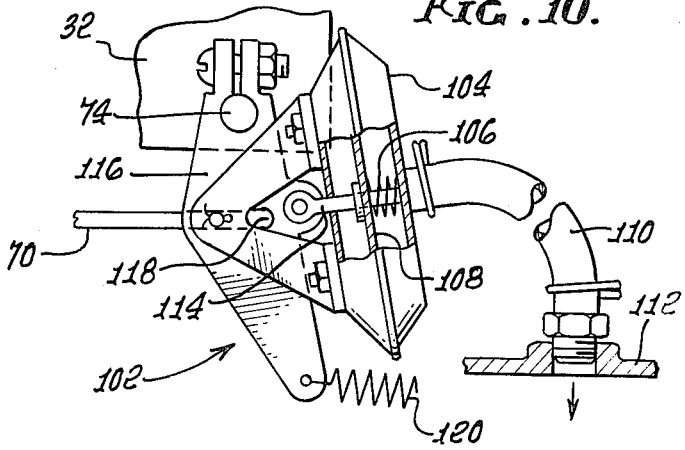
FIG. 10 is a plan view, partially in section, of alternate form of my first preferred embodiment incorporating an override vacuum actuator for adjusting the mixture ratio to engine manifold conditions.
Figure 11:
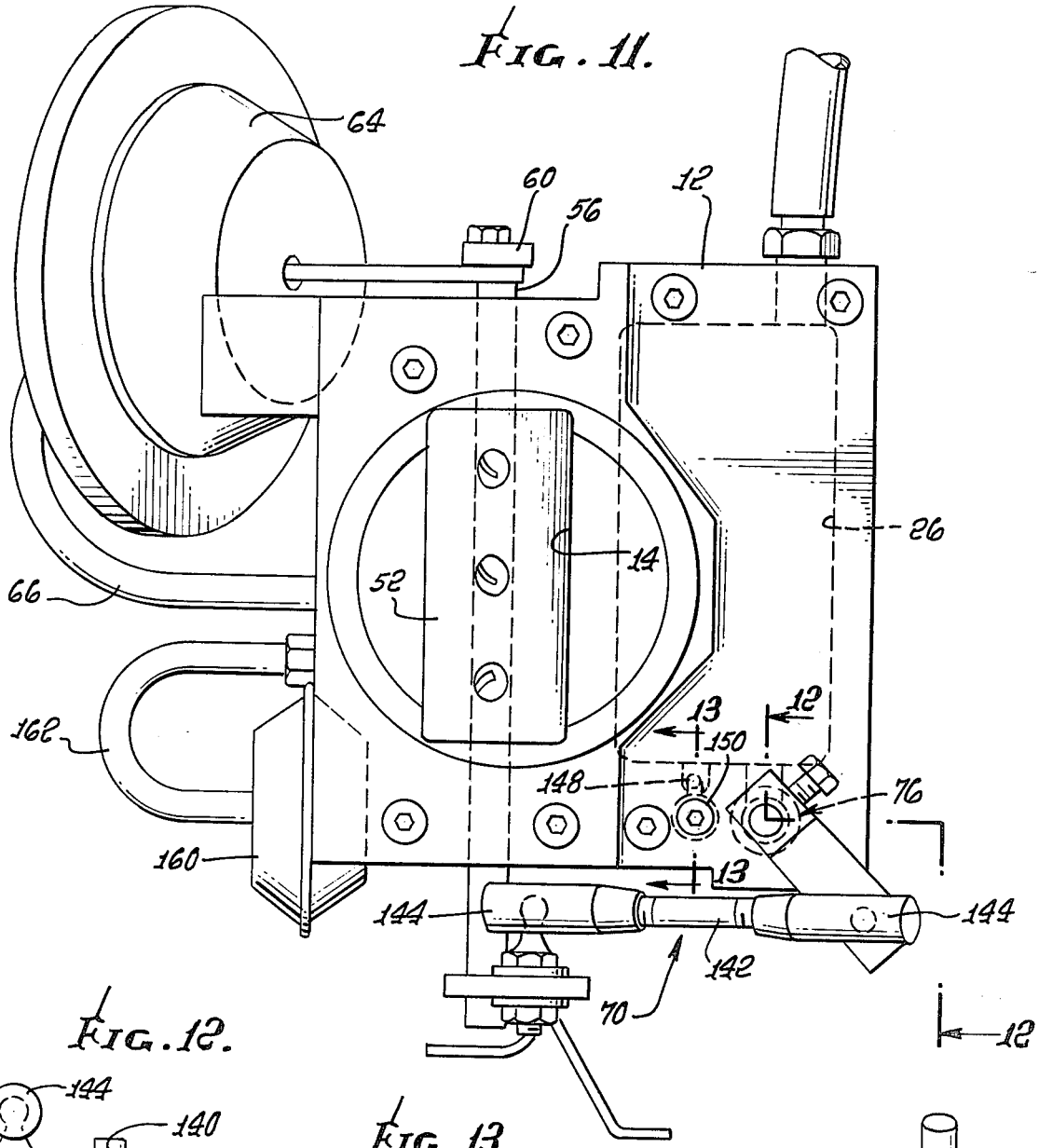
FIG. 11 is a plan view of a second preferred embodiment of my invention.
Figure 12:
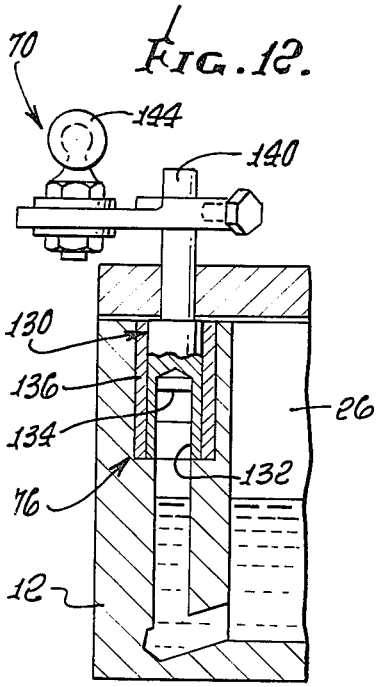
FIG. 12 is a sectional view of the fuel supply valve in my second preferred embodiment taken on 12—12 in FIG. 11.
Figure 13:
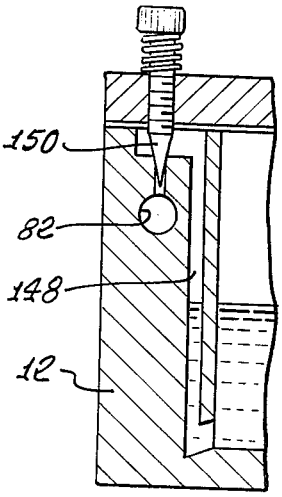
FIG. 13 is a sectional view of the idle circuit in my second preferred embodiment taken on 13—13 in FIG. 11.

In FIG. 10, I show a modification of my carburetor which permits enrichment of the combustible mixture under extreme acceleration conditions. The enrichment mechanism 102 utilizes a second vacuum responsive actuator 104 with a bias spring 106 which urges the diaphragm 108 to a position of full thrust. The vacuum responsive actuator is connected by hose 110 to the intake manifold 112 of the engine. The vacuum responsive actuator 104 is inter-connected to the fuel valve linkage 70 at the end which is coupled to the rotatable stem 74 of fuel supply valve 76. The fuel supply crank arm 72 is replaced by a bracket arm 116 which is coupled to the fuel valve linkage 70 by a moon-shaped slot 118. The slot 118 permits adjustment of the point of connection between the bracket arm 116 and the fuel valve linkage 70 for the distance of the slot. This adjustment has the same effect as elongating the fuel valve linkage 70 and results in a modification of the positional relationship between the rotary stem 74 of the fuel supply valve 76 and the blade 54 of the choke valve 52 and thus the fixed mixture ratio. The fuel valve linkage 70 is normally held at one end of the slot 118 by means of a bracket arm bias spring 120 and is moved toward the other end of the slot only when the vacuum responsive actuator 104 operates with sufficient force to overcome the bias of spring 120.

The vacuum responsive actuator 104 is mounted on the end of the fuel valve linkage 70 and the actuator lever 114 is attached to the bracket arm 116. Therefore extension of the actuator lever 114 from the vacuum responsive actuator 104 positions the end of the fuel valve linkage 70 in its normal mixture end of slot 118, and retraction of the actuator lever 114 positions the end of the fuel valve linkage 70 in an enriched mixture position in slot 118.

The operation of the enrichment mechanism 102 is as follows. When the engine is operating under normal requirements where the manifold vacuum will be about 14 to 18 inches of mercury, the vacuum responsive actuator 104 will be controlled by the spring 106 and the end of the fuel linkage 70 will be held in the normal mixture end of slot 118 by the bias spring 120. However, when the engine is placed under conditions of severe acceleration the manifold vacuum will drop, usually to a range of 12 to 8 inches of mercury, and the effect of this reduced vacuum on the diaphragm 108 of the vacuum responsive actuator 104 will overcome the bias of springs 106 and 120 and move the actuator lever 114 to carry the end of fuel valve linkage 70 to an enriched mixture position in the slot 118, and perhaps completely through the slot 118 to its enriched mixture end.

As soon as the engine has speeded up enough to overcome the severe acceleration requirement the manifold vacuum will return to its more normal range and the end of fuel valve linkage 70 will be moved back to its normal mixture end of the slot 118.

Therefore, the override type mixture enrichment provided by my enrichment mechanism is responsive directly to engine requirements and is effective only when needed. My normal fixed mixture ratio may then be set leaner, with resultant economies and yet excellent high performance characteristics can still be attained from the engine.

In FIGS. 11 through 22 I show a second embodiment of my invention. For simplicity and clarity, parts of my second embodiment which are substantially the same as in my first embodiment are given identical numbers. Parts which are substantially different are given new numbers.

In my second embodiment, the vacuum actuator 64 is mounted on the carburetor housing 12 at a canted angle to the throat 14 and the vacuum actuator crank arm 60 is disposed at a similar angle to form the interconnection with the air valve shaft 56. Since this lowers the top of the vacuum actuator, the carburetor has the advantage of a lower overall profile, equal to or less than nearly all well known carburetors presently in use on passenger cars, and is suited to receive nearly all air cleaners presently in use.

Figure 14:
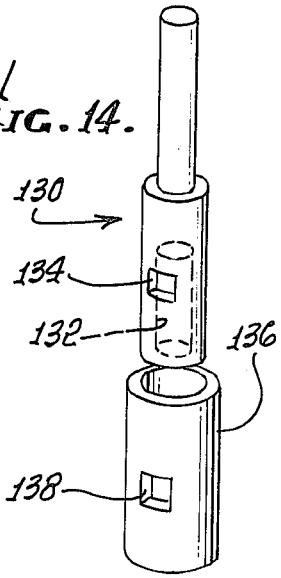
FIG. 14 is an exploded perspective view of the fuel supply valve in my second preferred embodiment.
Figure 15:
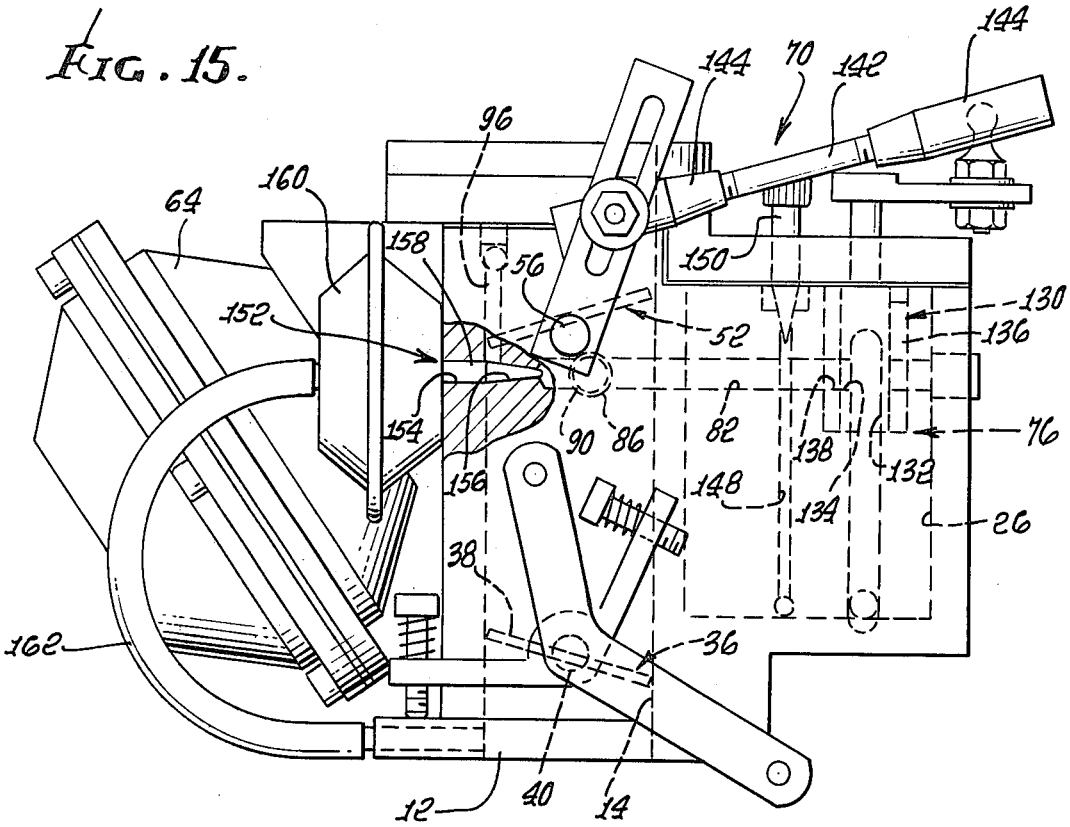
FIG. 15 is a side elevational view of my second preferred embodiment showing the demand valve for controlling pre-mix air in cutaway.
Figure 16:
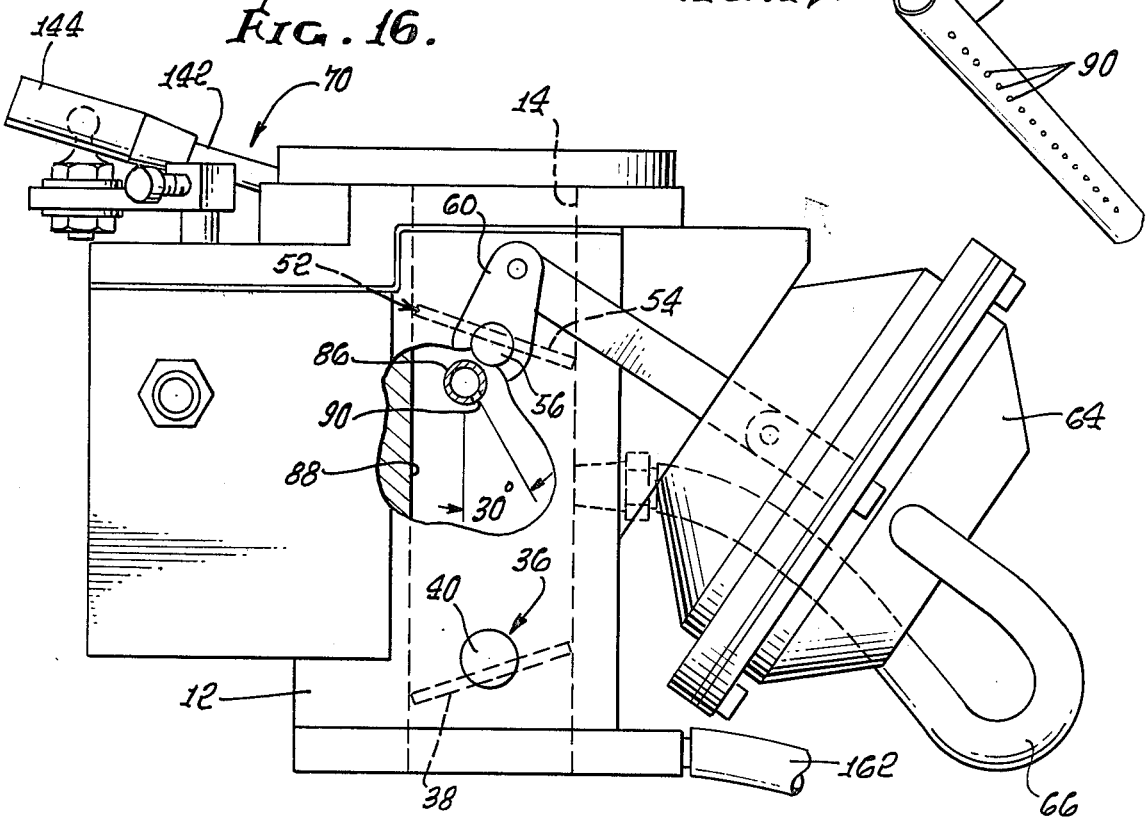
FIG. 16 is a side elevational view of my second preferred embodiment showing the opposite side of the carburetor from that shown in FIG. 15.
Figure 17:
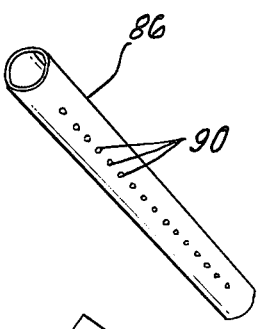
FIG. 17 is a perspective view of the nozzle of my second preferred embodiment.
Figure 18:
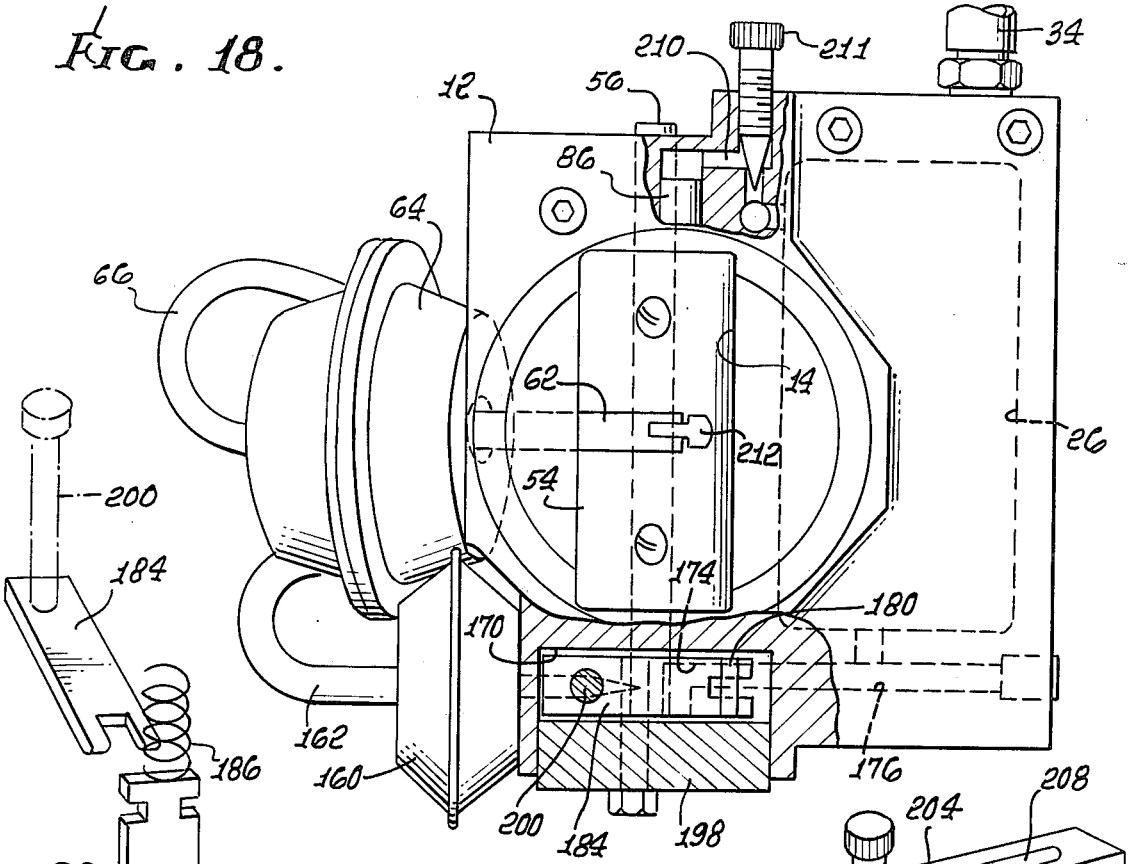
FIG. 18 is a plan view of a modified form of my second embodiment.
Figure 20:
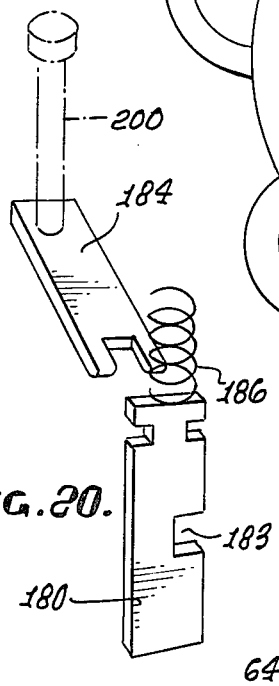
FIG. 20 is a perspective view of the fuel supply valve gate and actuating lever in the modified form of my second embodiment.
Figure 21:
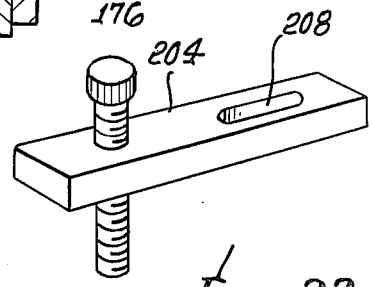
FIG. 21 is a perspective view of the fulcrum screw and mounting block in the modified form of my second embodiment.
Figure 19:
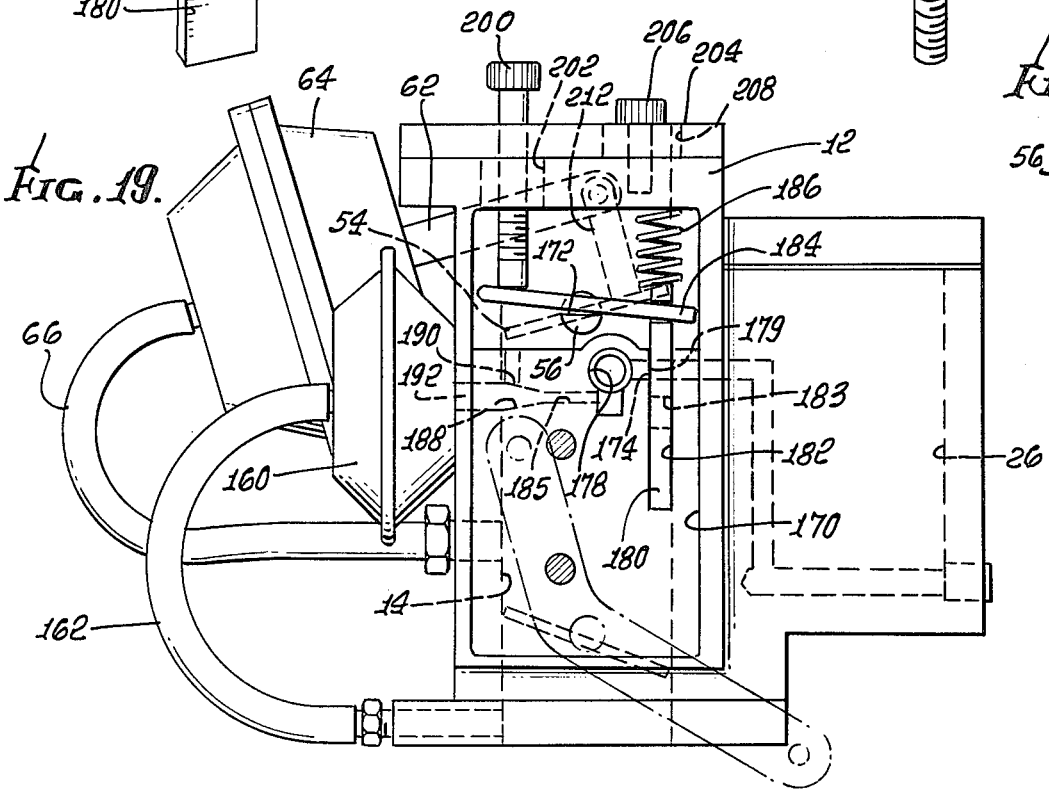
FIG. 19 is a side elevational view of the modified form of my second embodiment showing the fuel supply valve.
Figure 22:
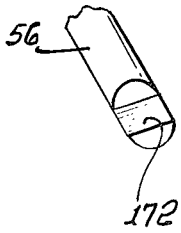
FIG. 22 is a perspective view of the fuel supply valve actuating cam in the modified form of my second embodiment.

Also, in my second embodiment the fuel supply valve 76 is constructed somewhat differently than in my first embodiment. In my second embodiment the valve has a rotatable stem 130 which is axially bored 132 from the bottom to a radically directed metering port 134 about midway up the stem. The metering port 134 is positioned just above the level of the fuel in the fuel supply reservoir 26 and is rotatable into alignment with the fuel supply channel 82, which in turn connects to one end of the nozzle 86. The fuel supply channel 82 and the orifices 90 in the nozzle 86 are positioned slightly above the level of fuel in the fuel supply reservoir so that fuel does not flow into the mixing chamber 88 by gravity, as in my first embodiment, but must be drawn in by the vacuum in the mixing chamber. To meter fuel through the fuel supply valve 76 in substantially a direct proportion to air passed by the air valve 52, the metering port 134 is made rectangular as shown in FIG. 14. Also, a sleeve 136 is wedged in the bore of the fuel supply valve 76 in the carburetor housing 12, which has a rectangular opening 138 aligned with the fuel supply channel 82. The sleeve 136 and stem 130 have their coacting surfaces mated to close tolerance to prevent leakage around the stem 130 above the port 134, and the stem has an upper end shaft 140 which projects through the cover plate 32 of the fuel supply reservoir, as in my first embodiment. The rectangular metering port 134 thus cooperates with rectangular opening 138 in the sleeve 136 to meter fuel from the fuel supply reservoir 26 into the fuel supply channel 82 in substantially the same proportions as air is passed by the air valve 52 through the rectangular throat 14 of the carburetor, as the stem 130 of the fuel supply valve 76 is rotated in response to movement of the air valve butterfly 54.

In this second embodiment, the fuel valve linkage 70 is made variable in length by disposing a thread rod 142 in two threaded end connectors 144, to permit adjustment between the respective positions of the air valve butterfly 54 and the stem 130 of the fuel supply valve 76 when the carburetor is in place on the engine. Such adjustment has been found beneficial in tuning the carburetors designed fuel mixture ratio to a particular engine.

The nozzle 86 in my second embodiment has thirty orifices 90 each with a bore diameter of twenty-eight thousands of an inch. In my first embodiment the nozzle 86 has eight orifices 90 each with a bore diameter of three-thirty seconds of an inch.

Also, though the orifices 90 in my second embodiment are all positioned in axial alignment along the nozzle periphery and the nozzle is axially aligned with and positioned just below the rod 56 of the air valve 52, as in my first embodiment, the orifices 90 in my second embodiment are directed angularly toward the wall of the throat 14 adjacent the downward moving edge of the butterfly blade 54 at about thirty degrees from a straight downward as in my first embodiment. This size and disposition of the orifices 90 provides a visually observable flow of atomized fuel from the orifices outward along the underside of the butterfly blade 54 in substantially equal proportions which curl upward over the edges of the blade into the downwardly passing air, giving what appears to be an excellent dispersion and mixing of the fuel into the air.

In my second embodiment, I provide an idle fuel channel 148, not present in my first embodiment. In this regard, it should be understood that in my first embodiment the cutaway passage 80 in the stem 74 of my fuel supply valve 76 permits a slight passage of fuel in its closed position to provide a source of start-up and to some extent idle fuel. Since the fuel is gravity fed to the mixing chamber 88, this permits a slight amount of soak during engine shutdown with a resultant excess of exhaust hydrocarbons at start up. I have avoided this condition in my second embodiment by eliminating the gravity feed of fuel to the mixing chamber, as previously described, and by providing the rectangular metering port 134 and rectangular sleeve opening 138 in the fuel supply valve which permit complete shutoff of fuel to the mixing chamber 88 on engine shutdown. Since this results in too lean a mixture at idle under certain engine conditions, I supplement the idle mixture by means of the idle fuel channel 148 which bypasses the fuel supply valve 76. The idle fuel channel 148 has an adjustable needle valve 150 regulatable while the carburetor is in operation so that the desired amount of supplemental idle fuel can be adjusted to a particular engine. Since in my second embodiment fuel is only drawn into the mixing chamber 88 when vacuum is present there, no shutoff on the idle fuel channel 148 is necessary.

In my second embodiment I have also provided a modified enrichment mechanism 152. In my first embodiment my enrichment mechanism 102 was arranged to modify the mechanical connection between the air valve 52 and fuel supply valve 76 to enrichen the designed fuel mixture ratio under conditions of extreme acceleration. Also, I provided a source of pre-mix air through pre-mix air supply channel 96 to increase atomization of the fuel.

Although in my first embodiment I accomplished the modification in mechanical connection by varying the point of interconnection between fuel valve linkage 70 and fuel supply valve bracket arm 116 with vacuum actuator 104, I have also accomplished similar results by mounting a vacuum actuator on the air valve rod 56 and interconnecting it to vary the point of connection between the fuel valve crank arm 58 and the fuel valve linkage 70. In this later arrangement a counterweight is mounted on the opposite end of air valve rod 56 to counterbalance the weight of the vacuum actuator.

In the modified enrichment mechanism 152 of my second embodiment, I accomplish the desired variations in designed fuel mixture ratio by varying the pre-mix air supply rather than the mechanical connection between the air valve 52 and the fuel supply valve 76. To do this I provide a needle bore 154 in the pre-mix air supply channel 96. A needle seat 156 is positioned in the channel 96 down stream from the needle bore 154 and a needle 158 is disposed in the needle bore 154 in a valving relationship with the needle seat 156 to regulate the passage of air through the channel 96 (see FIG. 15).

The positioning of the needle 158 in the needle bore 154 is accomplished by a vacuum actuator 160 mounted on the carburetor housing 12 adjacent the needle bore. The vacuum actuator 160 has a vacuum hose 162 which is connected in the discharge end 16 of the carburetor throat 14 just below the throttle valve 36. This exposes the diaphram in the vacuum actuator 160 to vacuum pressure in the intake manifold of the engine. The needle 158 is attached to the diaphram and, therefore, moves in the needle bore 154 in response to changes in the manifold vacuum.

The vacuum actuator 160 is so arranged that the needle 158 is moved inwardly upon a decrease in manifold vacuum, such as occurs on severe acceleration. Since inward movement of the needle 158 toward the needle seat 156 reduces the supply of pre-mix air passing through channel 96, the fuel passing out of nozzle 86 into the mixing chamber 88 contains less air and the mixture ratio is richer. Conversely, when the vacuum in the intake manifold increases substantially, as occurs on deceleration, the needle 158 is moved outwardly in the needle bore 154 and away from the needle seat 156, thereby increasing the amount of pre-mix air passing through channel 96. This results in a leaner mixture of fuel passing out of the nozzle 86 and a leaner fuel mixture ratio in mixing chamber 88.

In my second embodiment, both the air valve vacuum actuator 64 and the enrichment mechanism vacuum acutator 160 have internal springs which resiliently bias their respective diaphrams to adapt the range of their response to the system needs.

By utilizing the device of regulating pre-mix air to accomplish the variation of designed fuel mixture ratio to meet special engine conditions, I have found that my enrichment mechanism is considerably more sensitive and responsive. So successful has this approach been that I have expanded the function of my enrichment mechanism 152 to cause it to operate over nearly the full range of possible engine conditions, rather than to function only at a condition of severe acceleration. Not only does my enrichment mechanism begin to enrichen the designed fuel mixture ratio when even mild acceleration is called for, but it also begins to lean the designed fuel mixture ratio when mild deceleration occurs. As a result, my carburetor provides a continuous fine tuning of the fuel mixture for best engine performance in all conditions.

Intake manifold vacuum pressure has long been known to be an accurate indicator of engine conditions. Typically, manifold vacuum varies from a low of about two inches or less of mercury under extreme acceleration conditions, to a high of about twenty-two inches or more of mercury under extreme deceleration conditions. By setting my designed fuel mixture ratio for cruise conditions and leaning it or enriching it by shadowing intake manifold vacuum with my servo-type fine tuning enrichment mechanism 152, I am able to provide carburetation that is directly responsive to engine needs, with resultant increases in engine performance and economy, and reductions of harmful exhaust emissions. My experimentation indicates that delivery of fuel to the mixing chamber 88 by means of a metering type fuel supply valve 76 rather than a venturi jet, mixing fuel and air in a nearly constant vacuum rather than one which continuously varies (as in a venturi carburetor), and modifying the designed fuel mixture ratio in response to intake manifold vacuum are important features in such improvements in performance, economy and emission control.

Experimentation further indicates that since my carburetor provides a combustible mixture to the engine even during extreme deceleration, rather than the overly rich mixture typical of venturi type carburetors with an idle bypass circuit, oil consumption is reduced. It is my belief that this occurs because a high pressure differential across the piston rings and valve guides is avoided by delivery of a combustible mixture rather than an overly rich mixture to the engine cylinders during deceleration.

In FIGS. 18 through 22 I show a modification of the second embodiment of my invention in which the linkage between the air valve 52 and the fuel supply valve 76, and the fuel supply valve itself, are contained in a compartment of the carburetor housing. In this modification, a compartment 170 is formed in the carburetor housing adjacent the throat 14 on the side opposite the air valve vacuum actuator 64. The air valve rod 56 projects into the upper portion of the compartment 170 and carries a cam 172. A fuel supply channel 174 is formed in the compartment 170 to carry fuel from a fuel supply port 176 opening into the lower portion of the fuel supply reservoir 26 and a fuel discharge port 178 opening into the nozzle 86. The fuel supply valve 76 has a fuel metering opening 179 located in the channel 174 adjacent a fuel metering gate 180. The fuel metering gate 180 reciprocates in a slot 182 in the compartment 170 and has a fuel metering port 183 which co-acts with the fuel metering opening 179 to meter fuel passing through the channel 174.

A cam follower 184 is pivotally mounted in the top of the compartment 170 and has a distal end resiliently urged downward against the cam 172 by a cam follower spring 186. The cam follower 184 also has its distal end interconnected to the upper end of the fuel metering gate 180 so that pivotal movement of the cam follower reciprocates the gate.

The fuel metering opening 179 and the fuel metering port 183 are rectangular and co-act upon reciprocation of the fuel metering gate 180 in the slot 182 to meter fuel through the channel 174 in substantial proportion to the air passed by the air valve 52.

A pre-mix air port 185 is provided in the compartment 170 in communication with the pre-mix air supply channel 96 which opens into the carburetor throat 14 above the air valve 52. The pre-mix air port 185 connects with the fuel supply channel 174 down stream of the fuel supply valve 76 and pre-mix air is thereby supplied to the fuel passing through the channel 174 just prior to its entering the nozzle 86.

My enrichment mechanism 152 operates to vary the supply of pre-mix air by means of a needle bore 188. The needle bore 188 opens into the pre-mix air port 185 and has a needle seat 190. A needle 192 is reciprocally mounted in the needle bore 188 to co-act with the needle seat 190. The pre-mix air vacuum actuator 160 is mounted on the outside of the compartment 170 and is connected with the carburetor throat 14 below the throttle valve by hose 162 to reciprocate the needle 192 in the needle bore 188 varies the pre-mix air passing through the pre-mix air port 185 by reason of the co-action between the needle 192 and the needle seat 190 in the same manner as previously described in the first form of my second embodiment. Fuel supplied to the nozzle 86 is therefore metered by the co-action of the fuel metering gate 180 and fuel metering opening 179 in response to the positioning of the air valve 52, and pre-mix air is varied to enrich or lean the designed fuel mixture ratio by co-action of the needle 192 and needle seat 190 in response to the intake manifold vacuum as sensed by the pre-mix air vacuum actuator 160.

A cover plate 198 is provided which seals the compartment 170. A cam follower fulcrum screw 200 protrudes downward into the compartment 170 from the top of the carburetor housing 12 through a fulcrum screw slot 202. The fulcrum screw 200 is carried by a fulcrum screw block 204 mounted above the compartment 170 and held in place by a set screw 206 in a set slot 208. By reason of the slots 202 and 208 the fulcrum screw 200 is adjustible horizontally as well as vertically which permits regulation of the movement range as well as of the indexing of the fuel metering gate 180.

An idle fuel channel 210 is also provided which feeds the nozzle 86 from the opposite end to by-pass the fuel supply valve 76 as in the first form of my second embodiment. It is regulated by an idle adjustment screw 211.

Also, in this modified form of my second embodiment the air valve vacuum actuator 64 is centered with respect to the bore 14 and the actuator arm 62 passes up through the carburetor housing and attaches to the air valve shaft 56 by means of an upstanding ear 212 on the butterfly blade 54.

While this modified form of my second embodiment functions in substantially the same manner as the first form, the mechanisms for performing the functions are altered to provide the advantage of a completely self contained carburetor unit capable of being preset at the factory for optimum performance.

From this description it should also be understood that since the enrichment mechanism 152 of my second embodiment modifies pre-mix air rather than the mechanical interconnection between my air valve and fuel supply valve, it can be adapted for use on venturi type carburetor as well. To do this, a pre-mix air supply channel is connected into the fuel supply line up stream from the venturi jet and the air supply is regulated by intake manifold vacuum as above described.

Figure 23:
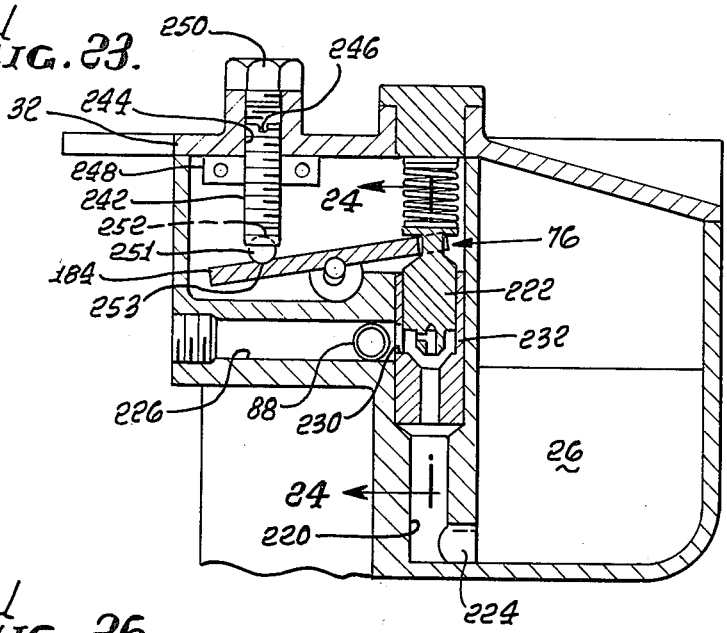
FIG. 23 is a sectional view of a third preferred embodiment of my invention showing the fuel supply valve and actuating structure.
Figure 25:
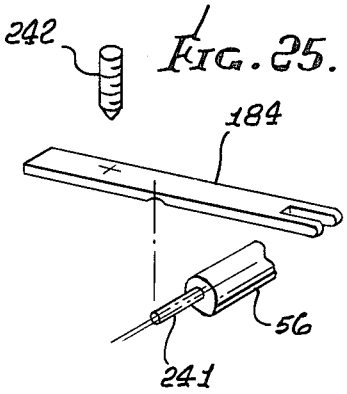
FIG. 25 is an exploded perspective view of the fulcrum screw and cam mechanism for actuating the fuel supply valve of FIG. 24.
Figure 24:
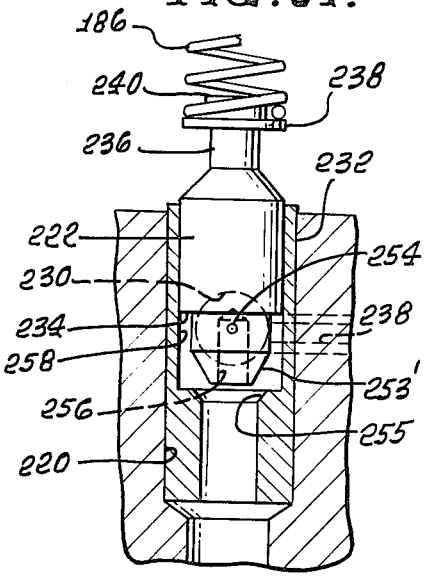
FIG. 24 is an enlarged sectional view of the cylindrical piston fuel supply valve gate shown in FIG. 23.

In FIGS. 23–32, I show further modifications which are possible with my improved carburetor. In FIGS. 23 to 25, I show the fuel supply valve 76 constructed with a vertically disposed cylindrical bore 220 in which a piston valve gate 222 vertically reciprocates. These elements replace the fuel metering gate 180 and slot 182 shown in FIG. 19. In this modification fuel is delivered to the valve bore 220 from the fuel supply reservoir 26 via a fuel supply channel 224. The fuel supply channel 224 interconnects with the fuel supply reservoir at a low point formed in the center of the reservoir. This assures an uninterrupted fuel supply even when the fuel in the reservoir is sloshed or tipped to one side by the centrifugal force of a high speed turn or other maneuver of the vehicle on which the carburetor is used. The fuel supply channel 224 delivers fuel from the fuel supply reservoir to the lower portion of the fuel supply valve bore 220, below the piston valve gate 222.

In this modification fuel is delivered from the fuel supply valve to the nozzle 88 in the carburetor throat via a fuel discharge channel 226 which communicates with a nozzle feed channel 228 that supplies the nozzle 88. The fuel discharge channel 226 has a fuel metering port 230 through which it communicates with the fuel supply valve bore 220. The fuel metering port 230 has a bore configuration as best shown in FIG. 24 and is preferably formed in an insert sleeve 232 swedged in the bore 220.

The piston valve gate 222 has a lower portion with an outside diameter which snugly fits the inside diameter of sleeve 232 in the bore 220 in a relationship which permits reciprocal travel of the piston gate 222 in the bore but prevents any substantial bypass of fuel between the piston and the sleeve. The lowermost portion of the piston gate 222 has a lip 234 formed normal to the vertical axis of the piston so that as the piston moves up and down across the bored fuel metering port 230 it meters fuel through an expanding opening similar to the action of a roll up window blind (see FIG. 24).

At its upper end, the piston valve gate 222 tapers inward to form a neck 236 above which a flange 238 is formed. On top of the flange 238 a cylindrical land 240 is provided to center the lower end of the cam follower spring 186. The cam follower 184 has a forked end which fits about the neck 236 in the upper portion of the piston to raise and lower the piston in a manner similar to that utilized to raise and lower the valve gate 222.

The cam follower 184 rides on a cam 241 formed on the end of the air valve butterfly rod 56 as an eccentric or offset pin, and is contained at its end opposite its connection with the piston valve gate 222 by a fulcrum screw 242 similar to the fulcrum 200. The fulcrum screw 242 is threaded in a screw hole 244 provided in the carburetor cover plate 32 and has a screw driver slot 246 at it upper end to permit adjustment and a lock nut 248 to hold it in a particular position. A cap screw 250 is provided to seal the fulcrum screw from unauthorized tampering.

To prevent any longitudinal play or shift of the cam follower 184 as it tilts in response to rotation of the cam 241, the lower end of the fulcrum screw 242 is provided with a spherical surface 251 which fits into a spherical cavity 252 in the screw and a semi-cylindrical groove 253 is formed in the under surface of the cam follower to receive the cam 241.

The fulcrum screw 242 is so adjusted that the cam follower 184 positions the lip 234 on the lowermost portion of the piston valve gate 222 below the fuel metering port 230 and the conical bottom surface 253 is at rest on its mating seat 255, when the engine is at idle. In this condition, idle fuel is provided by an idle passage 254 which communicates between a cavity 256 in the bottom of the piston 222 and an annular groove 258 formed in the piston surface just below the lip 234.

In this form the square fuel metering port 230 is not necessary since fuel is metered by the spacing relationship between the seat 255 and the valve surface 253.

The modified fuel supply valves shown in FIGS. 23–25 operate as follows. The valve surface 253 is disposed on the seat 255 at idle, thereby blocking the normal flow of fuel up the bore 220. Idle fuel is provided by the idle passage 254. As more combustible mixture is called for by opening the throttle valve 36, vacuum responsive actuator 64 opens the air valve 52, rotating the rod 56. As the rod 56 rotates, the cam 172 acts on the cam follower 184 to lift the piston 222, thereby raising the valve surface 253 off the valve seat 255. Fuel is then permitted to pass up the bore 220 through the valve seat 255 into the fuel discharge channel 226, and on to the nozzle 88 via the nozzle feed channel 228. The more the piston 222 is lifted, the more fuel flows up the bore 220.

The enrichment mechanism 152 of my second embodiment operates with this modified fuel supply valve in the same manner as previously described. The needle bore 156 is positioned in the opposite end of the fuel discharge channel 226 from where the channel connects to the bore 220. The needle 158 is disposed in the needle bore 156 and regulated by the vacuum actuator 160 to bleed pre-mix air from the pre-mix air supply channel 96 into the fuel discharge channel 226 (see FIGS. 18 and 19).

Figure 26:
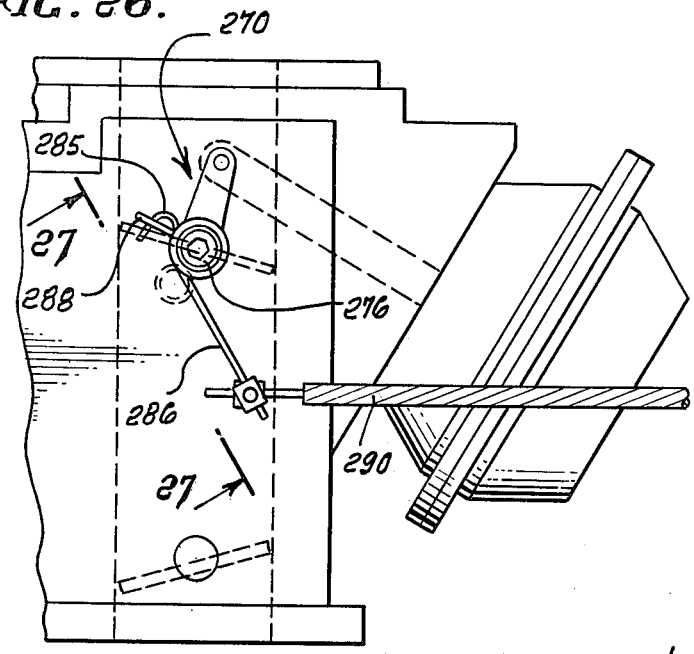
FIG. 26 is a partial elevational view showing a bias spring mounted on the air valve butterfly shaft for choking.
Figure 27:
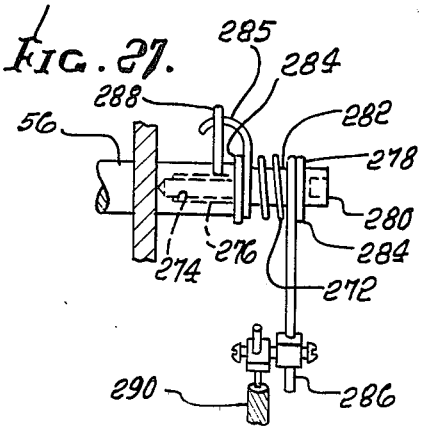
FIG. 27 is a view of the bias spring and shaft of FIG. 26, taken at 27—27 in FIG. 26.
Figure 28:
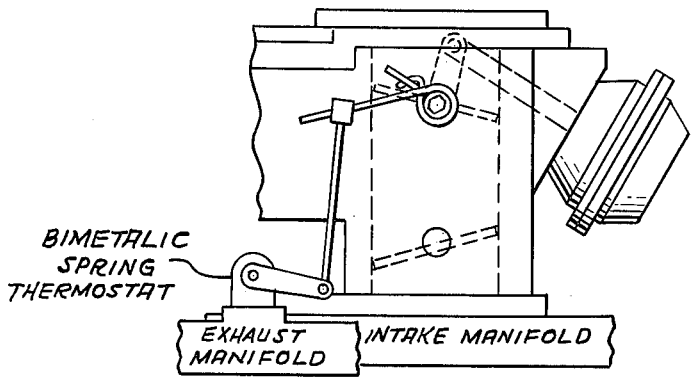
FIG. 28 is an elevational view of the bias spring choking mechanism of FIG. 26 modified for actuation from an engine heat well.

In FIGS. 26–28, I show a choking mechanism which can be used on my carburetor. The choking mechanism 270 consists of a coil spring 272 which is moutned on the air valve butterfly rod 56 at the end opposite from the end which carries the cam 172. This opposite end of the rod 56 projects from the carburetor housing 12 and has threaded bore 274 into which a choke screw 276 is threadedly secured. The choke screw 276 has a shoulder 278 adjacent its head 280. A choke sleeve 282 is mounted on the outer portion of the choke screw 276 between two washers 284, and this assembly is held between the outer end of the rod 56 and the shoulder 278 on the choke screw 276 when the screw is threaded in the bore 274. The spring 272 is mounted on the rod 56 with the sleeve 282 passed through its coils.

The coil spring 272 has a lock end 285 and a drive end 286. The lock end 285 is crooked, and the drive end 286 is formed into an extended leg. An attachment pin 288 is secured in the end of the rod 56 inboard of the sleeve 282 and projects radially outward from the shaft through the crook in the lock end 284 of the coil spring. With the parts thus positioned, the lock end 285 of the coil spring 272 engages the attachment pin 288 and torques the rod 56 in a direction which forces the air valve in a closing direction when leverage is applied to the drive end 286 to coil the coil spring 272. Thus levering the drive end 286 of the coil spring 272 in a direction which coiled up spring delivers a resilient force to the air valve 52, which biases the air valve in a closed direction and overcomes some of the opening force being delivered to the air valve by the vacuum responsive actuator 64 via the actuator linkage 62 (see FIGS. 19, 20 and 26). This closing bias from the choke mechanism 270 enriches the air fuel mixture by reducing the air flow through the air valve 52 and improves engine response during warm up.

The drive end 286 of the coil spring 272 can be urged to coil the spring by either a manual control cable 290, operated by the driver from the vehicle cab (see FIG. 27), or by a heat sensitive device on the engine of the type presently used for automatic chokes (see FIG. 28). The heat well type automatic choke actuator which mounts on the manifold is preferred for my carburetor because activation of the choke mechanism is only useful for a short warm up period and heat well devices respond more quickly to engine conditions.

Figure 29:
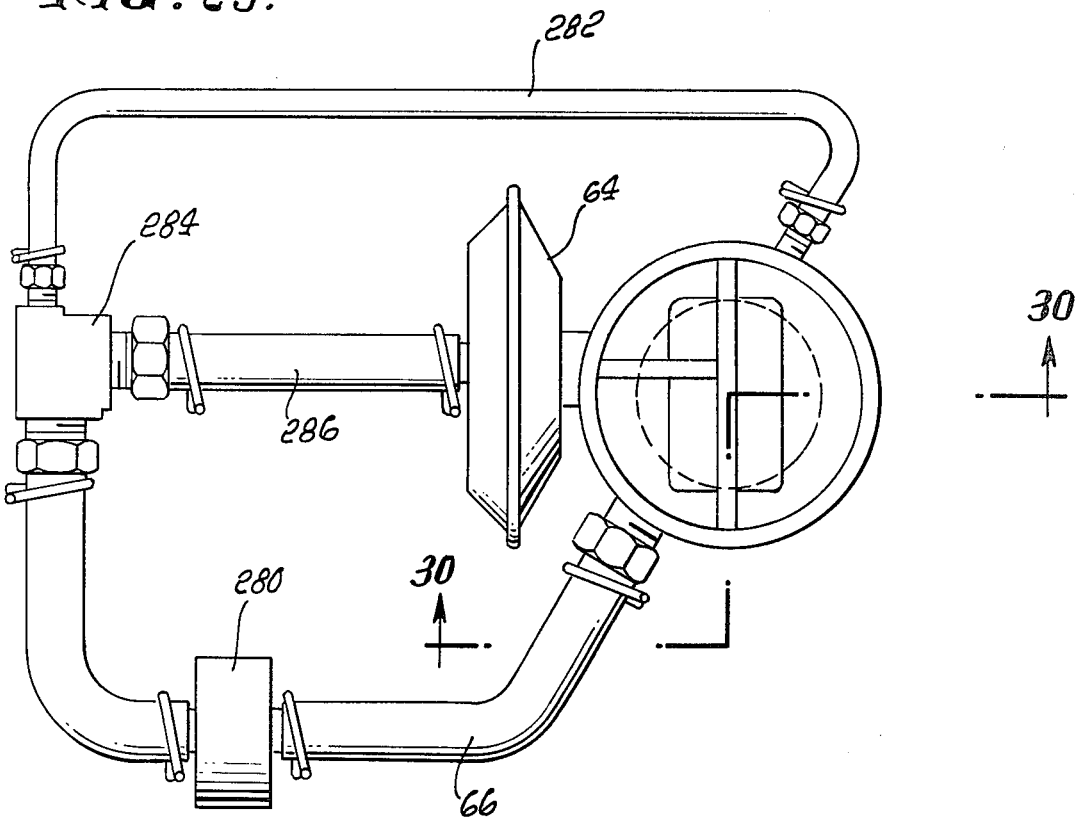
FIG. 29 is a schematic of a two channel vacuum system for biasing the air valve for cold starts.
Figure 30:
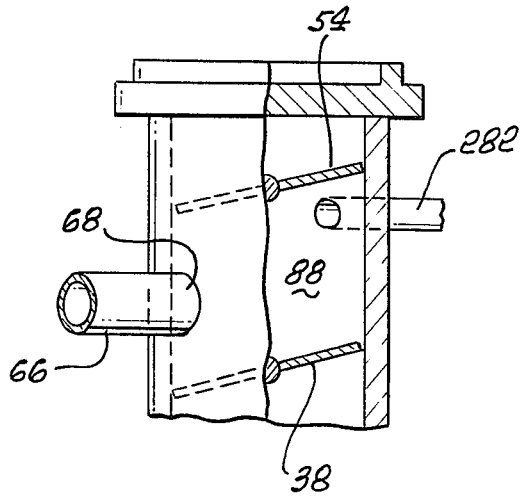
FIG. 30 is an illustrative view of the carburetor bore showing the connection points of the vacuum channels in FIG. 29.

In FIGS. 29 and 30 I show a modified manner of biasing the air valve for cold weather starts. In this form the control vacuum hose 66 has a thermal valve 280 inserted in it between the vacuum responsive actuator 64 and the carburetor throat 14. An alternate vacuum hose 282 is provided which interconnects with the main vacuum hose 66 in a T-connector 284. Both hoses are then connected to the vacuum responsive actuator 64 by T-hose 286.

The alternate vacuum hose 282 is substantially smaller in diameter than the main vacuum hose 66 and connects to the throat 14 of the carburetor 10 at a point just below the air valve butterfly 54. At this point in the mixing chamber 88 the vacuum is at its lowest because it is only a short distance and gradient to the atmospheric pressure existing above the butterfly.

Therefore, on cold starts, the main vacuum hose 66 will be closed by thermal valve 280 and the only available vacuum for opening the air valve 52 through the vacuum responsive actuator 64 will be the vacuum in the restricted alternate vacuum hose 282. Since this vacuum will be minimal, the opening of the butterfly 54 of the air valve will be delayed and restricted resulting in a richer warm up mixture. When the engine is warm enough to open thermal valve 280, the main vacuum hose 66 will take over control of the vacuum responsive actuator 64 and normal operation will be resumed.

Figure 31:
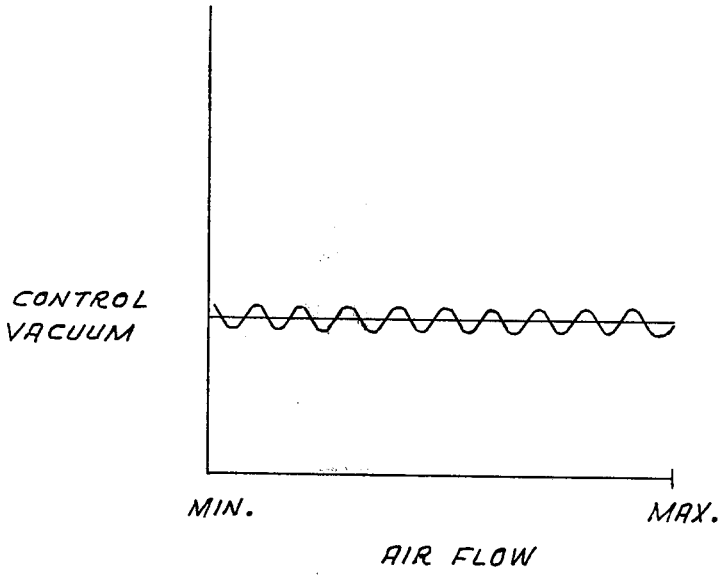
FIG. 31 is a graphic presentation of control vacuum plotted against air flow in the carburetor throat.
Figure 32:
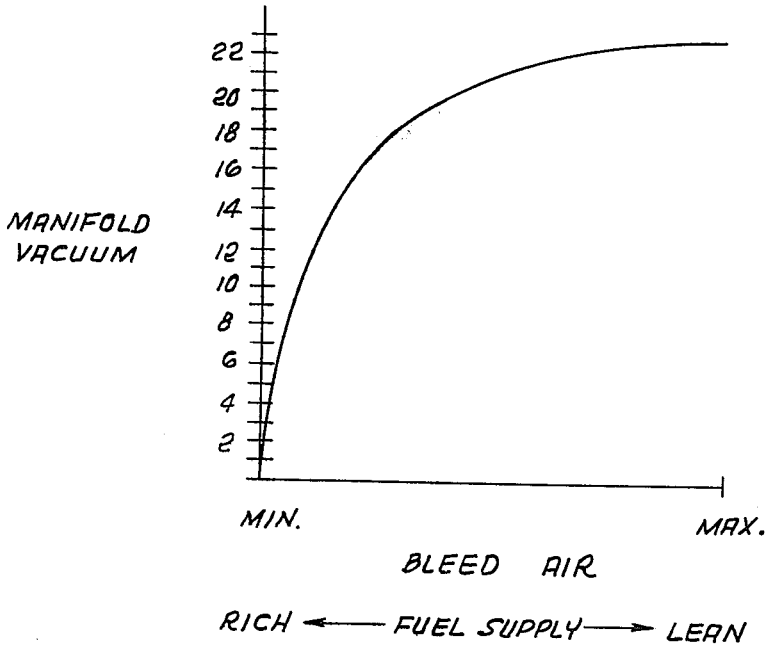
FIG. 32 is a graphic presentation of manifold vacuum plotted against bleed air in the fuel supply conduit showing the modification of the air to fuel mixture by the override system in response to engine demand.

In FIGS. 31 and 32, I show diagramatically the action of my vacuum responsive actuator 64 and my modified enrichment mechanism 152. As illustrated by FIG. 31, the vacuum control to which the supply of fuel and air are responsive is not dependent on air flow through the carburetor throat 14 as in the venturi carburetor. Instead, the air valve 52 and consequently the interconnected fuel valve 76 are responsive only to attempted changes in combustion chamber pressure, and they immediately react to return conditions to and stabilize them at the predetermined combustion chamber vacuum standard, In this case, one-half inch of mercury.

In FIG. 32, I illustrate the operation of my modified enrichment mechanism which provides a varying supply of bleed air into the fuel supply line. By proper adjustment, the bleed air feed a cruise will thin out the fuel in the fuel supply channel sufficiently to give an effective combustible mixture with the air passing through the air valve 52. When the engine is rapidly accelerated, the drop in manifold vacuum cuts back the bleed air supply thus enriching the mixture. Conversely, when the engine is placed in deceleration, the resultant increase in manifold pressure causes an increase in bleed air which leans the mixture.

Figure 33:
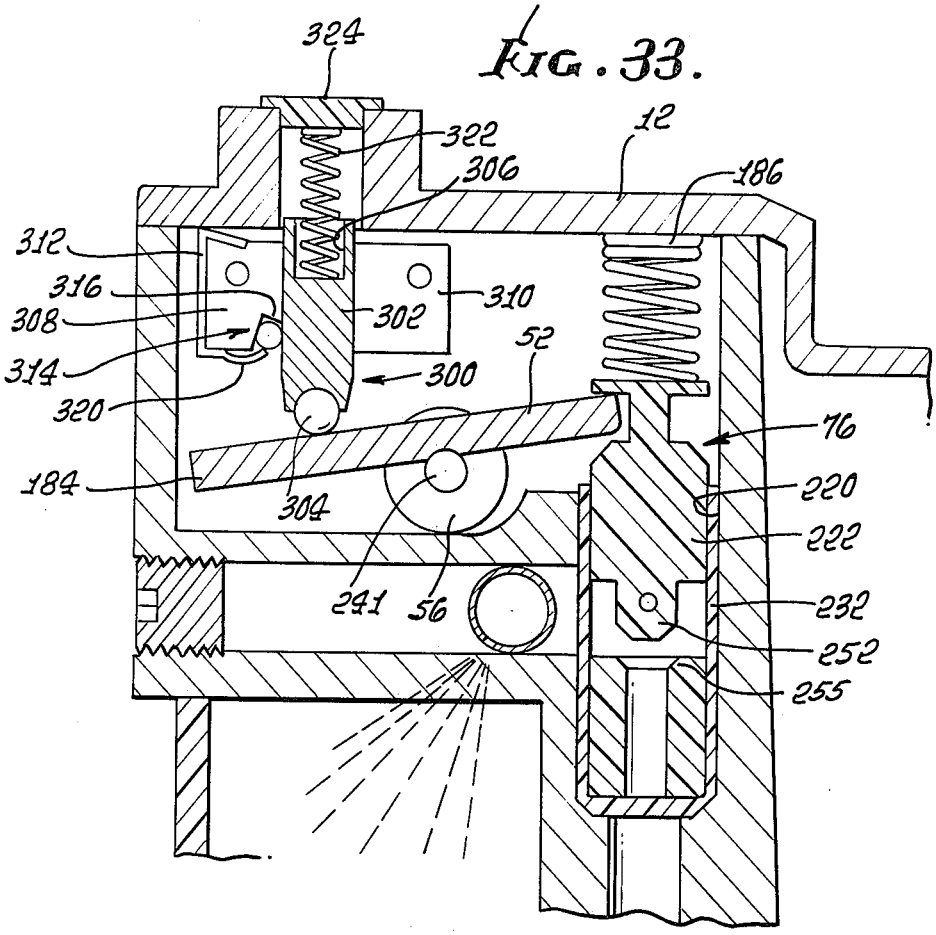
FIG. 33 is an enlarged sectional view of the fuel supply valve actuating structure in the third preferred embodiment of my invention showing a modified form of the fulcrum screw and cam mechanism.
Figure 34:
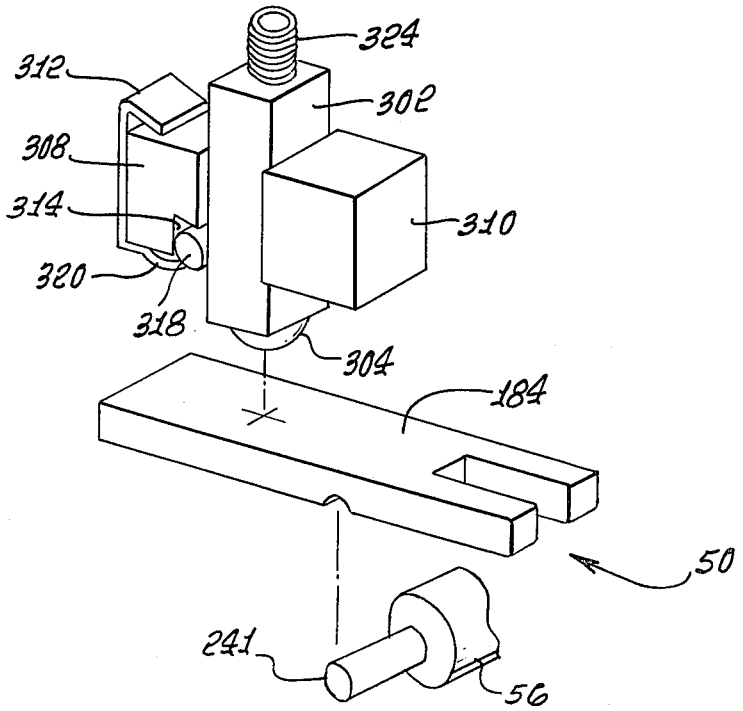
FIG. 34 is an enlarged perspective view of the modified fulcrum screw and cam mechanism shown in FIG. 33.

In FIGS. 33 and 34, I show a further modification of the fulcrum mechanism which operates the piston valve gate 222 of the fuel supply valve 76. The modified fulcrum screw 300 has a square shaft 302 with a ball 304 inserted in its lower end and a spring recess 306 provided in its upper end. The shaft 302 reciprocates between a pair of guide blocks 308 and 310 which are secured to the carburetor housing 12. The first guide block 308 has friction lock mechanism 312 which permits downward travel of the shaft 302, but locks against upward travel. The friction lock mechanism 312 consists of a cut out cam notch 314 with a cam surface 316 which tapers upwardly and inwardly with respect to the shaft 302. A knurled roller 318 is positioned in the cam notch 314 and held in place by a spring clip 320.

To bias the shaft 302 in a downward direction a shaft spring 322 is seated in the spring recess 306 at the upper end of the shaft and placed in compression by a fulcrum screw cap 324. When the shaft 302 is urged downwardly by the shaft spring 322 the roller 318 is driven downwardly and outwardly on the cam surface 316 releasing locking pressure on the shaft and permitting downward movement. On the other hand when the shaft 302 attempts to move upwardly the roller 318 is driven upwardly and inwardly on the cam surface 316 to lock the shaft against movement.

Upon original assembly, the piston valve gate 222 is positioned at the lower portion of the sleeve 232 in the bore 220 with the valve surface 253 seated on the valve seat 255, and the air valve 52 is closed so the pin cam 241 on the air valve rod 56 is in its lowermost position. Thus when the shaft 302 of my modified fulcrum screw 300 is inserted between the guide blocks 308 and 310 and urged downwardly by assembly of the shaft spring 322 and fulcrum screw cap 324, the shaft moves downwardly into firm contact with the cam follower 184. Since the cam follower spring 186 is substantially larger and more forceful than the shaft spring 322, the shaft 302 will become fixed at this position and remain there as a fulcrum for the cam follower 184 when the piston valve gate 222 is reciprocated up and down by the rotation of the air valve rod 56 through the cam follower 184 as the carburetor operates. If wear occurs between the pin cam 241 and the cam follower 184 the shaft 302 will move downward slightly to accommodate for the wear and maintain snug relationship with the cam follower.

Accordingly, my modified fulcrum screw 300 is self adjusting and may be sealed at the factory, thereby eliminating the possibility of misadjustment in the field and providing maximum benefit from my carburetor's improved performance characteristics.

Figure 35:
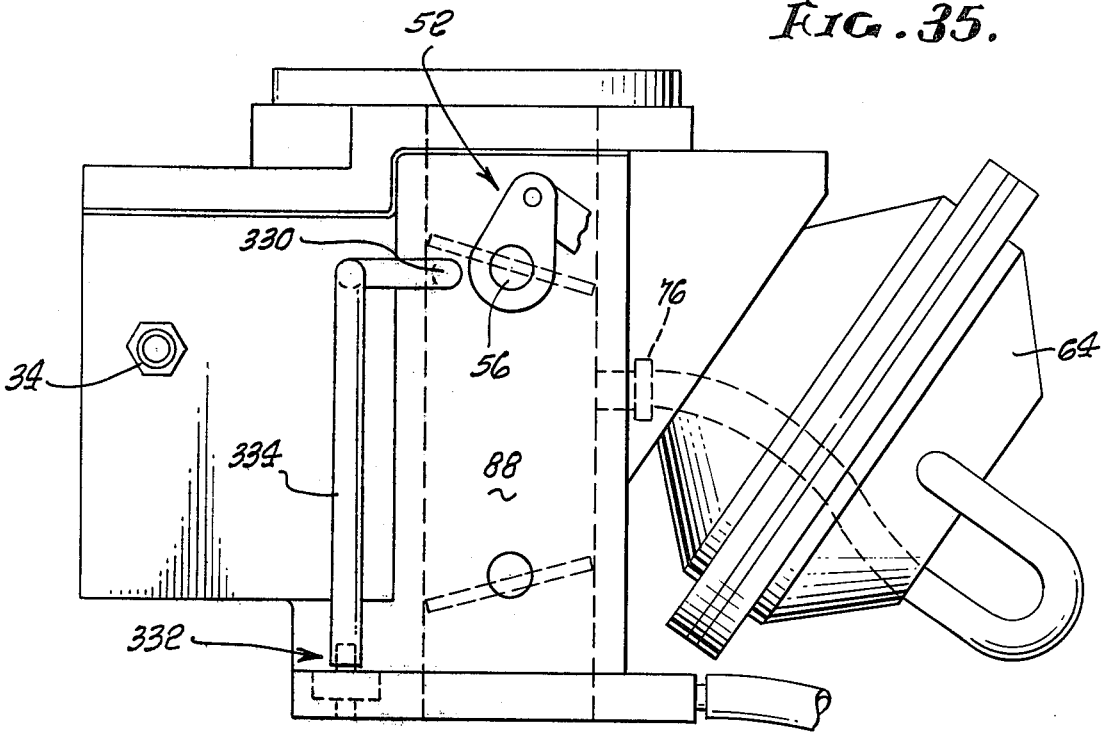
FIG. 35 is a side elevational view of my carburetor showing a modified cold start system.
Figure 36:
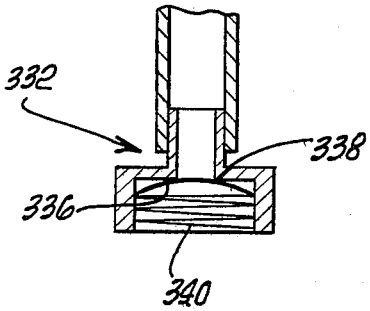
FIG. 36 is an enlarged sectional view of a heat controlled valve used in the modified cold start system shown in FIG. 35, with the valve in its closed position.
Figure 37:
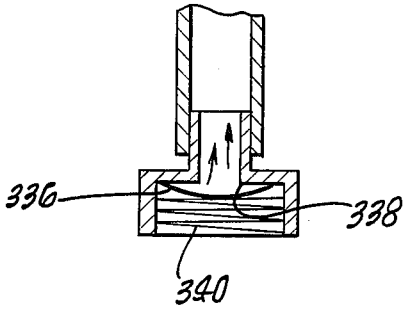
FIG. 37 is an enlarged sectional view of the heat controlled valve of FIG. 36 with the valve in its open position.

In FIGS. 35 through 37, I show a further modification of my cold start mechanism. My modified cold start mechanism 328 includes a cold start port 330 in the upper portion of the mixing chamber 88, a temperature responsive valve 332 and an interconnecting air passage 334.

The cold start port 330 is located just below the air valve 52 and the valve 332 is mounted on the carburetor base to sense manifold and engine block temperature.

The valve 332 is open to the atmosphere at one end and is connected to the cold start port 330 at the other end by the air passage 334. The valve 332 has a bi-metallic spider disc 336 which is urged into juxtaposition with a valve seat 338 by a disc bias spring 340. Then the disc 336 is cold it crowns upwardly as shown in FIG. 36 and seals against the valve seat 338. When warm, the disc 336 crowns downwardly and opens the valve 332 to the atmosphere.

On a cold start, the valve 332 is closed to the atmosphere and as the vacuum in the mixing chamber 88 is lowered, by opening the throttle valve 36, air valve 56 is opened and opens the fuel supply valve 76 to provide fuel at a predetermined air-fuel ratio. In this modification the air-fuel ratio is enriched so that cold starting is readily accomplished. After the engine is warm, the valve 332 opens and bleed air is supplied to the mixing chamber 88 through the air passage 334. The bleed air enters the mixing chamber 88 via the coldstart port 330 and leans the enriched mixture for normal driving conditions. The superior performance of my carburetor in comparison with the presently used venturi type carburetors can now be explained. Since acceleration and deceleration cause the greatest difficulties in operation and efficiency, and deceleration produces the greatest emission problems, the comparison will be directed primarily to these engine conditions. Considering deceleration first, the problems which result in the venturi type carburetor are these. The gasoline drawn into the carburetor is proportionate to the vacuum pressure at the venturi ports. Since during deceleration the engine is still turning quite fast and the throttle closes off outside air, the vacuum in the intake manifold raises and this rise in vacuum is reflected to a great extent on the idle circuit, which bypasses the throttle valve. This, plus percolation of gas from the venturi jet, results in an excessively rich mixture which floods the engine cylinders. This mixture is passed through the cylinders with minimal burning and out the exhaust to produce an emission high in unburned gasoline components. This also results in backfiring unless afterburning devices are used, and in other undesirable engine action such as oil pumping through the valves and cylinders.

In my carburetor these difficulties are overcome because deceleration immediately urges an increase in mixing chamber pressure which is responded to by the air valve vacuum actuator closing the air valve and thereby shutting off both air and fuel proportionately. While the supply of combustible mixture is only shut down to idle, because of the idle position throttle stop, the combustible mixture which passes into the engine is not excessively enriched but instead is of the same designed fuel mixture ratio proper for the engine. (In my second embodiment this may be leaned somewhat by the fine tuning effect of my enrichment mechanism 152 if engine conditions call for it.) Harmful emissions from unburned gasoline are thereby greatly reduced, and no backfiring or flooding occurs because the engine continues to properly burn the combustible mixture received.

On acceleration, the venturi carburetor must be equipped with an accelerator pump for high performance of the engine. This appears to be due to the system inertia problems in a venturi carburetor. That is, when the engine calls for more combustion mixture, the air flow speeds up in response thereto faster than the liquid fuel flow, thereby causing too lean a mixture with resultant stalling, and stuttering. In my carburetor, the urging of a reduction of pressure (increase of vacuum) in the mixing chamber will cause the air valve to open increasing both air and fuel supplies simultaneously, and the proper fuel mixture ratio will be maintained and where necessary, enrichened to meet engine requirements by my enrichment mechanism.

Thus on both acceleration and deceleration, where the venturi carburetor is troubled by too rich and then too lean a mixture, my carburetor maintains the designed fuel mixture ratio, modified as necessary for fine tuning by my enrichment mechanism, and the result is optimum combustion efficiency with greatly improved emission control and substantially better economy and performance.

I have found, in fact, that my carburetor can provide these benefits with a smaller barrel or bore than the comparable venturi type carburetor, which I attribute primarily to the lack of any substantial vacuum in the mixture chamber thus removing any drag effect on mixture passing out of throat exit 16.

Experience has indicated that my carburetor will work effectively on a pressure regulated fuel supply system, as well as on the float and bowl type fuel supply reservoir, and on a two barrel carburetor as well as a single barrel.

It should also be understood from this description that although I have described my carburetor as useful in a gasoline powered engine, it could also be applied to a diesel engine and to any other type engines where components, whether gaseous or liquid, are mixed to form a combustible mixture and supplied to the engine.

I claim:

1. In an air valve carburetor having a throat, a throttle valve at the exit of the throat, an air valve at the entrance of the throat, a vacuum responsive actuator for driving said air valve in response to the vacuum pressure in the throat, a fuel nozzle disposed in the throat, a fuel reservoir and a fuel supply valve interconnected between the fuel reservoir and the fuel nozzle, means for interconnecting said fuel supply valve with said air valve, comprising:

a chamber in the housing of said carburetor disposed to contain said fuel supply valve;

a shaft interconnected with said air valve and rotatable upon adjustment of said valve, said shaft having an end projecting into said chamber;

a cam surface on the end of said shaft;

a cam follower disposed for engagement and movement by said cam surface upon rotation of said shaft, said cam follower being an elongated member with an anchor end and an action end and being disposed for engagement by said shaft intermediate said ends;

adjustable anchor means operatively associated with the anchor end of said cam follower, said anchor means being disposed to engage and hold said anchor end of said cam follower in a fulcrum position and being adjustable to change said fulcrum position; and interconnection means on the action end of said cam follower interconnecting said action end with the fuel supply valve for regulation of said fuel supply valve in response to rotation of said shaft and cam surface;

said adjustable anchor means including a fulcrum shaft reciprocally movable vertically in said housing with a lower end disposed in contact with said cam follower, resilient means operatively associated with an upper end of said shaft and disposed to urge said shaft downwardly, and one-way lock means disposed operatively associated with said fulcrum shaft and disposed to permit downward movement thereof and prevent upward movement thereof.

2. Means for interconnecting the fuel supply valve with the air valve in an air valve carburetor as described in claim 1, in which:

said cam follower is an elongated flat member;

said adjustable anchor means shaft has a contact end disposed to engage the anchor end of said cam follower, said contact end having a spherical contact surface; and a semi-cylindrical groove in the lower surface of said cam follower disposed for engagement by said cam surface, said cam surface having a convex surface mated to the semi-cylindrical surface on said cam follower.

3. Means for interconnecting the fuel supply valve with the air valve in an air valve carburetor as described in claim 1, in which:

said cam follower is forked at its action end and said fuel supply valve has a cylindrical valve gage disposed in a generally vertical bore and has a head at its upper end with a neck portion which receives said forks in supportive engagement therewith.

4. An air valve carburetor of the type described in claim 1 which further includes a choke mechanism comprising:

a bleed air conduit interconnected at one end to said carburetor throat between said air valve and said throttle valve and having its other end connected to the atmosphere; and a thermal responsive valve juxtaposed said engine block and responsive to the temperature thereof, said valve being disposed in said bleed air conduit to control the passage of fluid therethrough.

5. An air valve carburetor of the type described in claim 1 in which:

said fulcrum shaft has a spherical surface at its lower end;

said fulcrum shaft has a polygonal cross section and reciprocates in a bore having a mated bore periphery, whereby axial rotation of said fulcrum shaft in said bore is prevented; and said one-way lock means includes a cam surface adjacent said fulcrum shaft bore, said cam surface being directed upwardly and inwardly with respect to the axis of said bore, and a cylindrical lock pin disposed between said cam surface on said fulcrum shaft with its axis perpendicular to the axis of said fulcrum shaft.

6. An air valve carburetor of the type described by claim 1 which further includes a choking mechanism comprising:

a cylindrical shank interconnected with the shaft of said air valve and extended external of the housing of said carburetor, said shank having a pair of spaced parallel shoulders thereon;

a coil spring disposed on said shank between said shoulders with said shank passing through the coils thereof, said spring having a drive end and an anchor end;

spring anchoring means operatively associated with said anchor end of said spring and disposed to anchor said anchor end to said air valve shaft to drive said air valve shaft in a direction which resiliently biases said air valve toward a closed position when said spring is coiled; and drive means interconnected with the drive end of said spring and actuatable to drive said drive end in a direction which coils said spring.

7. A choke mechanism as described in claim 6 in which:

said drive means includes a heat responsive device movable in response to engine temperature.

8. An air valve carburetor of the type described by claim 1 which further includes a choke mechanism comprising:

a main vacuum conduit interconnecting said vacuum responsive actuator with said carburetor throat between said air valve and said throttle valve, said main vacuum conduit having a thermal responsive valve disposed therein which opens only after exposurto engine heat;

an auxiliary vacuum conduit interconnecting said vacuum responsive actuator with said carburetor throat between said air valve and said throttle valve, said auxiliary vacuum conduit having a flow capacity substantially less than the flow capacity of said main vacuum conduit.

9. A choke mechanism as described in claim 8, in which:

said auxiliary vacuum conduit has a flow capacity less than half of the flow capacity of said main vacuum conduit with said thermal responsive valve open.

10. In an air valve carburetor having a throat, a throttle valve at the exit of said throat, an air valve at the entrance of said throat, a vacuum responsive actuator for driving said air valve in response to vacuum pressure in said throat, a fuel nozzle disposed in said throat for delivery of fuel thereto, a fuel supply reservoir, and a fuel metering compartment, a fuel supply metering means comprising:

a generally vertical bore formed in said compartment and having an intake passage at its lower portion interconnected with said fuel supply reservoir and a discharge passage at its upper portion interconnected with said nozzle;

a cylindrical piston disposed in said bore and reciprocally movable therein, said piston having an outside diameter substantially equal to the inside diameter of said bore to prevent passage of liquid fuel therebetween;

fuel metering means formed in said bore, said fuel metering means including an orifice disposed between said intake passage and said discharge passage of said bore, and a metering surface on the lower end of said piston disposed to cooperate with said orifice and meter fuel therethrough upon reciprocation of said piston;

a shaft on said air valve rotatable therewith having an end projecting into said compartment;

cam means on the end of said shaft;

a cam follower in said compartment disposed for engagement and movement by said cam upon rotation of said shaft, said cam follower having an action end and anchor end;

adjustable fulcrum means mounted in said housing and engagable with the anchor end of said cam follower; and interconnecting means operatively associated with the action end of said cam follower and an upper end of said fuel supply valve piston for interconnecting said piston with said cam follower, whereby said piston is reciprocated in said bore in response to movement of the action end of said cam follower in response to rotation of said air valve shaft;

said adjustable fulcrum means including a fulcrum shaft reciprocally movable vertically in said housing with a lower end disposed in contact with said cam follower, resilient means operatively associated with an upper end of said shaft and disposed to urge said shaft downwardly, and one-way lock means disposed operatively associated with said fulcrum shaft and disposed to permit downward movement thereof and prevent upward movement thereof.

11. An air valve carburetor as described in claim 10, in which:

said fulcrum shaft has a spherical surface at its lower end;

said fulcrum shaft has a polygonal cross section and reciprocates in a bore having a mated bore periphery, whereby axial rotation of said fulcrum shaft in said bore is prevented; and said one-way lock means includes a cam surface adjacent said fulcrum shaft bore, said cam surface being directed upwardly and inwardly with respect to the axis of said bore, and a cylindrical lock pin disposed between said cam surface on said fulcrum shaft with its axis perpendicular to the axis of said fulcrum shaft.

* * * * *